US011008187B2

(12) United States Patent
Nuita

(10) Patent No.: US 11,008,187 B2
(45) Date of Patent: May 18, 2021

(54) SHEET CONVEYING DEVICE AND IMAGE FORMING APPARATUS

(71) Applicant: TOSHIBA TEC KABUSHIKI KAISHA, Tokyo (JP)

(72) Inventor: Akira Nuita, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 244 days.

(21) Appl. No.: 16/364,707

(22) Filed: Mar. 26, 2019

(65) Prior Publication Data

US 2020/0307928 A1 Oct. 1, 2020

(51) Int. Cl.

| | |
|---|---|
| ***B65H 1/28*** | (2006.01) |
| ***B65H 1/26*** | (2006.01) |
| ***B65H 7/04*** | (2006.01) |

(52) U.S. Cl.

CPC ..... *B65H 1/28* (2013.01); *B65H 1/26* (2013.01); *B65H 7/04* (2013.01); *B65H 2301/51212* (2013.01); *B65H 2404/152* (2013.01)

(58) Field of Classification Search

CPC ... B65H 1/26; B65H 1/28; B65H 7/04; B65H 2301/51212; B65H 2404/152

See application file for complete search history.

(56) References Cited

U.S. PATENT DOCUMENTS

| | | | | |
|---|---|---|---|---|
| 5,195,734 | A * | 3/1993 | Tanabe | B65H 3/44 271/164 |
| 5,971,387 | A * | 10/1999 | Kita | B65H 1/26 271/147 |
| 7,866,654 | B2 * | 1/2011 | Ohno | B65H 1/28 271/9.08 |
| 7,988,142 | B2 * | 8/2011 | Sugiyama | B65H 1/28 271/9.01 |
| 9,823,610 | B2 * | 11/2017 | Kai | G03G 15/6502 |
| 2015/0130124 | A1 * | 5/2015 | Muto | B65H 1/28 271/9.03 |

FOREIGN PATENT DOCUMENTS

| | | | |
|---|---|---|---|
| JP | H09-2675 | A | 1/1997 |
| JP | 2002104669 | A * | 4/2002 |

* cited by examiner

*Primary Examiner* — Patrick Cicchino

(74) *Attorney, Agent, or Firm* — Kim & Stewart LLP

(57) ABSTRACT

A sheet conveying device includes an auxiliary tray, a sheet feeding tray, a roller, a driving mechanism, and a pickup roller. The sheet feeding tray is adjacent to the auxiliary tray on a lateral side of the auxiliary tray. The roller is configured to move in a thickness direction of a sheet bundle placed on the auxiliary tray to contact an end of the sheet bundle facing the sheet feeding tray. The driving mechanism is configured to laterally move the auxiliary tray to be on top of the sheet feeding tray when the sheet bundle placed on the auxiliary tray is transferred to the sheet feeding tray. The pickup roller is configured to pick up a sheet one by one from the sheet bundle transferred to the sheet feeding tray.

20 Claims, 12 Drawing Sheets

SHEET CONVEYING DEVICE AND IMAGE FORMING APPARATUS

FIELD

Embodiments described herein relate generally to a sheet conveying device and an image forming apparatus.

BACKGROUND

A sheet conveying device of an image forming apparatus stores a sheet bundle. The sheet conveying device separates the uppermost sheet of the sheet bundle and then conveys the separated sheet. Some types of a sheet conveying device may have a separation sheet feeding mechanism for preventing multi-feeding of sheets.

However, sheets of a new sheet bundle obtained from a package tend to stick to each other. The adhesion of sheets may overcome an attempted sheet separation by the separation sheet feeding mechanism depending on the type, the preserved state, and the like of the sheets.

DETAILED DESCRIPTION

In general, according to an embodiment, a sheet conveying device includes an auxiliary tray, a sheet feeding tray, a roller, a driving mechanism, and a pickup roller. The sheet feeding tray is adjacent to the auxiliary tray on a lateral side of the auxiliary tray. The roller is configured to move in a thickness direction of a sheet bundle placed on the auxiliary tray to contact an end of the sheet bundle facing the sheet feeding tray. The driving mechanism is configured to laterally move the auxiliary tray to be on top of the sheet feeding tray when the sheet bundle placed on the auxiliary tray is transferred to the sheet feeding tray. The pickup roller is configured to pick up a sheet one by one from the sheet bundle transferred to the sheet feeding tray.

First Embodiment

Hereinafter, a sheet conveying device and an image forming apparatus according to a first embodiment will be described with reference to the drawings.

Figure 1:
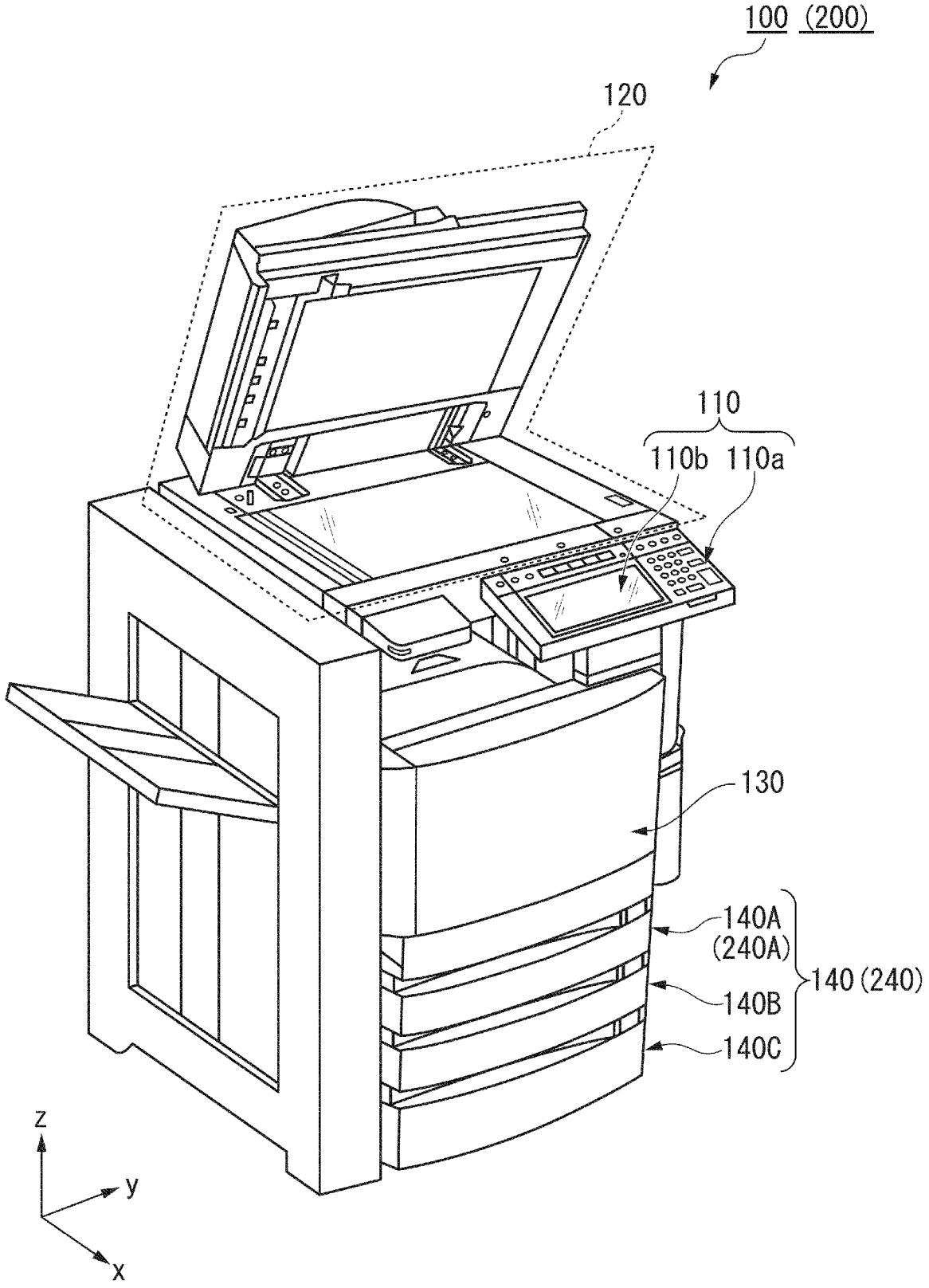
FIG. 1 illustrates a perspective view of an image forming apparatus according to a first embodiment.
Figure 2:
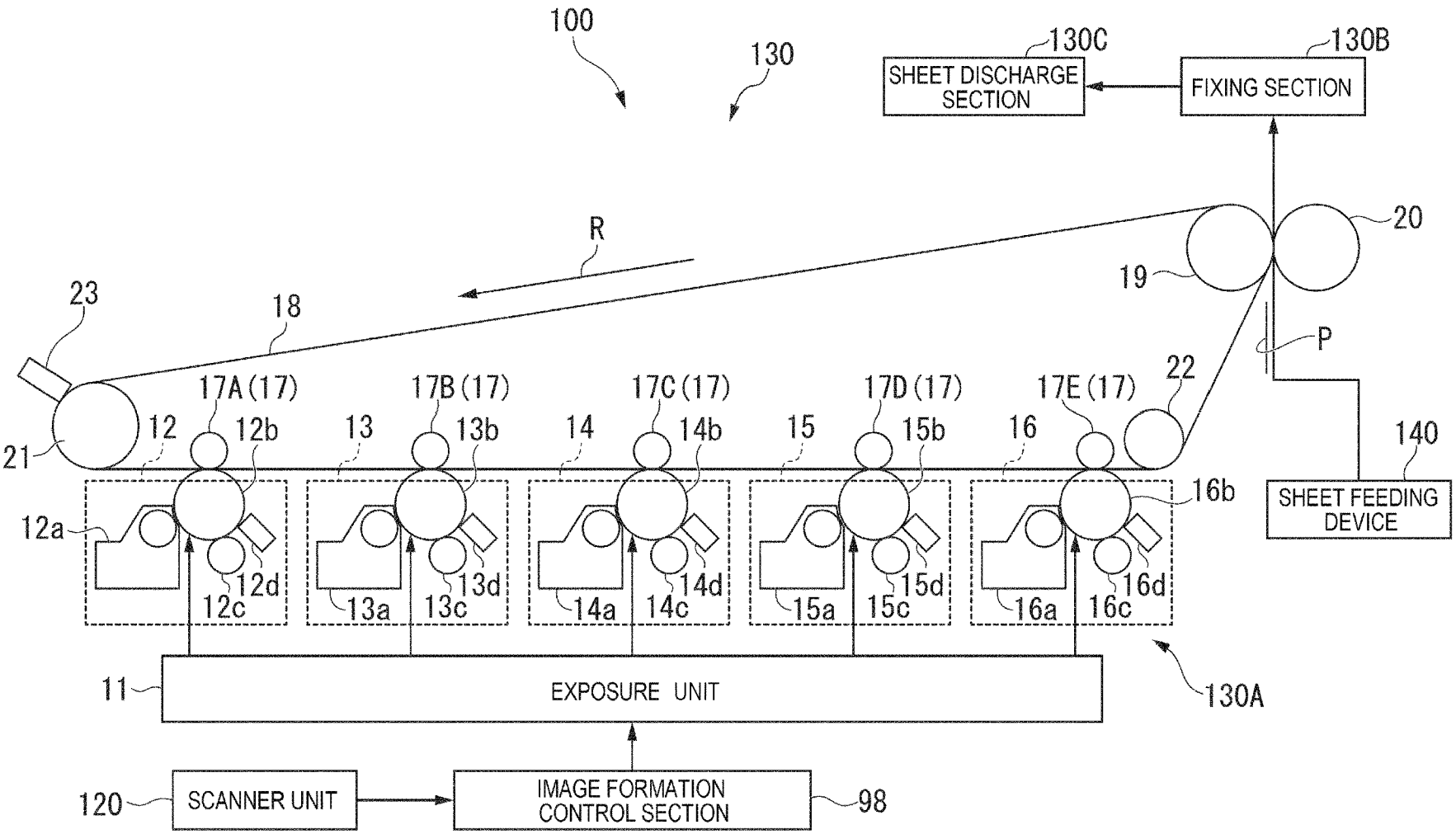
FIG. 2 illustrates a schematic side view of main elements of the image forming apparatus.
Figure 3:
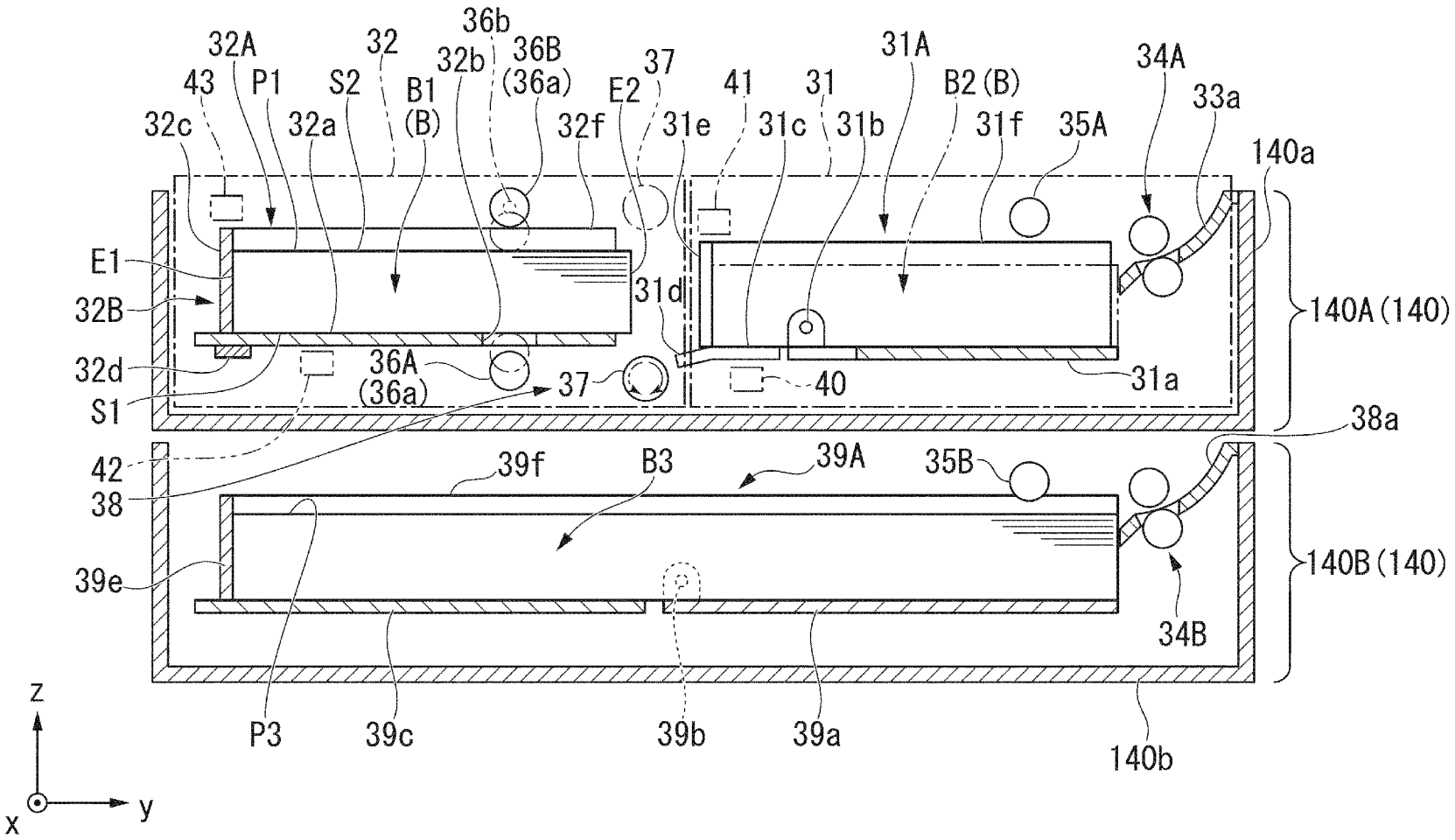
FIG. 3 illustrates a cross-sectional view of a sheet feeding device of the image forming apparatus.
Figure 4:
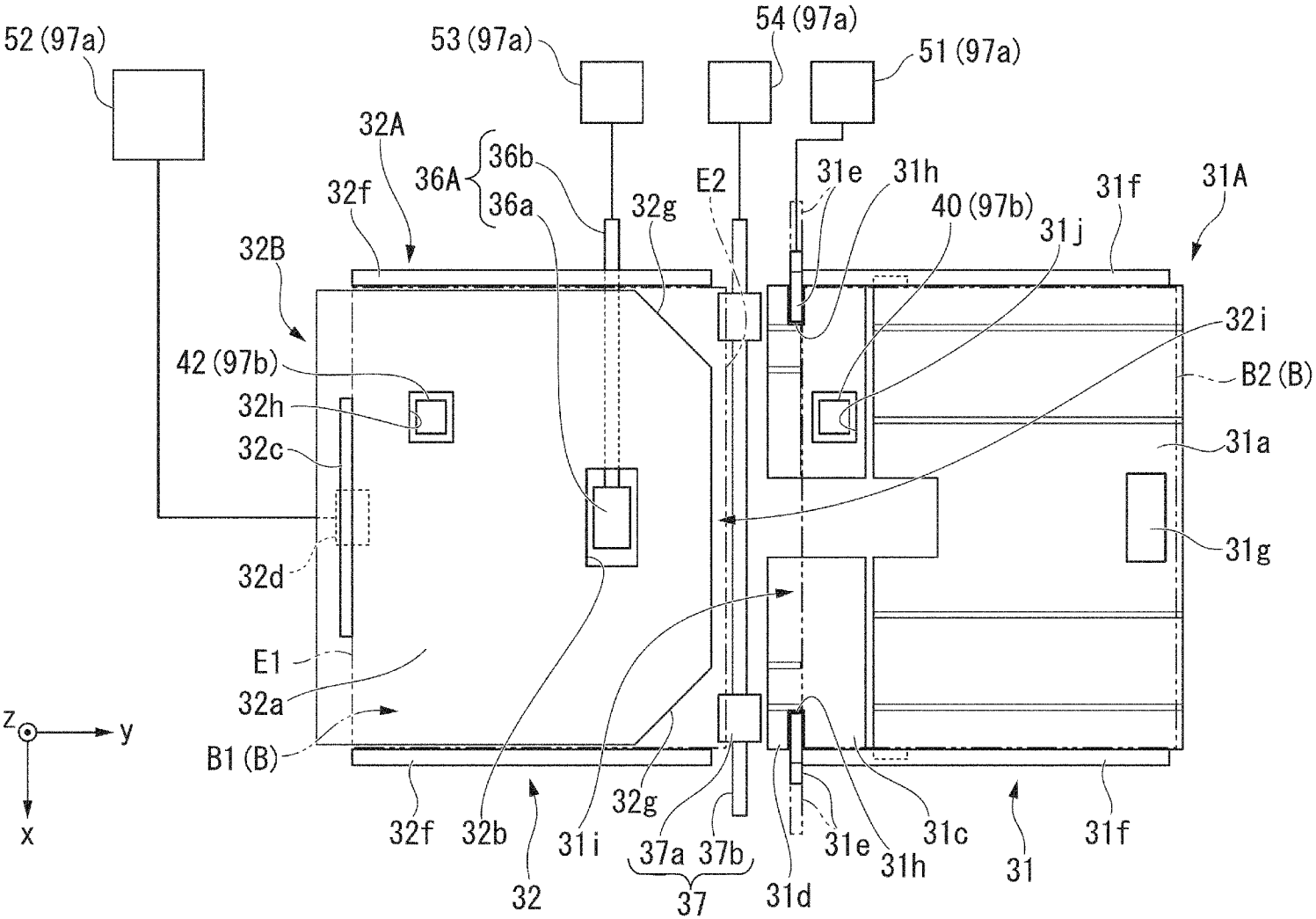
FIG. 4 illustrates a plane view of main elements of a sheet conveying device.

FIG. 1 illustrates a perspective view of the image forming apparatus according to the first embodiment. FIG. 2 illustrates a schematic side view of main elements of the image forming apparatus according to the first embodiment. FIG. 3 illustrates a cross-sectional view of a sheet feeding device of the image forming apparatus according to the first embodiment. FIG. 4 illustrates a plane view of main elements of a sheet conveying device according to the first embodiment.

In each drawing, unless specifically stated otherwise, the same elements are denoted by the same reference numerals (the same applies to the drawings below).

An image forming apparatus 100 illustrated in FIG. 1, for example, is a multifunctional peripheral. The image forming apparatus 100 includes an operation unit 110, a scanner unit 120, a printer unit 130, and a sheet feeding device 140.

The image forming apparatus 100 forms an image on a sheet using a developer such as toner. A sheet used in the image forming apparatus 100, for example, is a paper, a label paper, a resin sheet, a postal card, an envelope and the like. The type (paper type) of the sheet is not limited as long as the image forming apparatus 100 can form an image on the surface of the sheet.

Hereinafter, when a relative position, a direction and the like are referred to in the image forming apparatus 100, an xyz rectangular coordinate system illustrated in FIG. 1 is used. In the xyz rectangular coordinate system, x axis is an axis line extending from a rear side to a front side of the image forming apparatus 100 on a horizontal plane. A positive (negative) direction of x axis is a direction from the rear side to the front side (from the front side to the rear side) of the image forming apparatus 100. y axis is an axis line extending from a left side to a right side of the image forming apparatus 100 on the horizontal plane when viewed from the front side to the rear side of the image forming apparatus 100. A positive (negative) direction of y axis is a direction from the left side to the right side (from the right side to the left side) of the image forming apparatus 100. x axis and y axis are perpendicular to each other. z axis is an axis line extending from a lower side to an upper side of the image forming apparatus 100. z axis is perpendicular to x axis and y axis. A positive (negative) direction of z axis is an upward (a downward) vertical direction.

Directions along the axis lines of x axis, y axis, and z axis will be described as an x axis direction, a y axis direction, and a z axis direction, respectively.

The operation unit 110 includes a display 110*a* and a control panel 110*b*.

The display 110*a*, for example, is an image display device such as a liquid crystal display and an organic electroluminescence (EL). The display 110*a* displays various kinds of information on the image forming apparatus 100.

The control panel 110*b* includes a plurality of buttons. The control panel 110*b* receives a user's operation. The control panel 110*b* outputs a signal corresponding to an operation performed by a user to a control unit of the image forming apparatus 100. The display 110*a* and the control panel 110*b* may be configured as an integral touch panel.

The scanner unit 120 obtains information on an image to be read based on brightness and darkness of light. The scanner unit 120 records the image information. The recorded image information may be transmitted to another information processing apparatus via a network. The recorded image information may be formed into an image on a sheet by the printer unit 130.

The printer unit 130 forms the image on the sheet on the basis of the image information generated by the scanner unit 120 or image information received via a communication path.

In an example of an internal configuration of the printer unit 130 as illustrated in FIG. 2, the printer unit 130 includes an image forming section 130A, a fixing section 130B, and a sheet discharge section 130C.

In the example illustrated in FIG. 2, the image forming section 130A has a quintuple tandem type configuration. However, the image forming section 130A needs not to be limited to the quintuple tandem type.

The image forming section 130A includes an exposure unit 11, an intermediate transfer belt 18, developing units 12, 13, 14, 15, and 16 (may be written by the developing units 12 to 16 below), a plurality of primary transfer rollers 17 (17A, 17B, 17C, 17D, and 17E; may be written by 17A to 17E below), and a secondary transfer roller 20.

The exposure unit 11 irradiates light to photosensitive drums (which will be described later) of the developing units 12 to 16, thereby forming an electrostatic latent image. The exposure unit 11, for example, includes a light source of laser, a light emitting diode (LED) and the like.

The exposure unit 11 is communicably connected to an image formation control section 98 (described below). The exposure unit 11 modulates light on the basis of an image signal sent from the image formation control section 98.

The intermediate transfer belt 18 is a specific example of an image carrying member. The intermediate transfer belt 18, for example, is an endless belt. Inside the intermediate transfer belt 18, a driving roller 19 and driven rollers 21 and 22 are disposed.

The driving roller 19 rotates the intermediate transfer belt 18 in a direction indicated by an arrow R. In the present embodiment, an upstream and a downstream are defined on the basis of a direction in which the intermediate transfer belt 18 moves.

Between the driven rollers 21 and 22, the intermediate transfer belt 18 is stretched in a planar shape. The driven roller 21 is disposed at the downstream side of the driving roller 19. The driven roller 22 is disposed at the upstream side of the driving roller 19. On the surface of the intermediate transfer belt 18 wound around the driven roller 21, a belt cleaner 23 is disposed. The belt cleaner 23 removes remaining toner on the surface of the intermediate transfer belt 18.

For example, in order to apply tension to the intermediate transfer belt 18, the driven roller 21 may be urged in a direction away from the driven roller 22. For example, for the purpose of applying tension to the intermediate transfer belt 18, the position of the driven roller 21 may be fixed and a tension roller (not illustrated) may be added. In such a case, the tension roller may urge the intermediate transfer belt 18 between the driving roller 19 and the driven roller 21 from an inside.

On the surface of the intermediate transfer belt 18 between the driven roller 21 and the driven roller 22, the developing units 12 to 16 are disposed. The developing units 12, 13, 14, 15, and 16 are disposed in this order from the upstream to the downstream.

The developing units 12 to 16 form visible images using toner having different characteristics. For example, in some developing units, toner having different colors may be used. As toners having different colors, a toner of each color of yellow Y, magenta M, cyan C, and black K may be used. For example, in some developing units, a toner, which is discolored by external stimulation (for example, heat), may also be used.

The configurations of the developing units 12 to 16 are identical to one another except for a difference in the characteristics of toner used. Hereinafter, the configuration of the developing unit will be described while focusing on an example of the developing unit 12.

The developing unit 12 includes a photosensitive drum 12*b*, a charging device 12*c*, a developing device 12*a*, and a cleaning blade 12*d*. Each developing unit X (X is any one of 13, 14, 15, and 16) includes a photosensitive drum Xb, a charging device Xc, a developing device Xa, and a cleaning blade Xd similarly to the photosensitive drum 12*b*, the charging device 12*c*, the developing device 12*a*, and the cleaning blade 12*d*.

The photosensitive drum 12*b* includes a photoreceptor (a photosensitive area) on the outer peripheral surface thereof. The photoreceptor, for example, is an organic photoconductor (OPC). The photosensitive drum 12*b* is rotated in a clockwise direction by a motor (not illustrated). A rotation linear speed of the photosensitive drum 12*b* coincides with a rotation speed of the intermediate transfer belt 18.

The charging device 12*c* uniformly charges a surface of the photosensitive drum 12*b*. When light is irradiated to the charged surface of the photosensitive drum 12*b* from the exposure unit 11, an electrostatic latent image corresponding to an image signal is formed.

The developing device 12*a* stores a developer including toner. The developing device 12*a* attaches toner to the photosensitive drum 12*b* according to the potential of the electrostatic latent image formed on the photosensitive drum 12*b*. The toner attached to the photosensitive drum 12*b* visualizes the electrostatic latent image.

The cleaning blade 12*d*, for example, is a plate-like member. The cleaning blade 12*d*, for example, is configured with rubber such as urethane resin. The cleaning blade 12*d* removes remaining toner and the like attached onto the photosensitive drum 12*b*.

The primary transfer rollers 17A to 17E transfer the visible images, which are formed on the photosensitive drums 12*b* to 16*b* by the developing units 12 to 16, to the intermediate transfer belt 18. The visible images are superposed on the intermediate transfer belt 18.

The secondary transfer roller 20 is disposed facing the driving roller 19 with the intermediate transfer belt 18 interposed therebetween.

Between the intermediate transfer belt 18 and the secondary transfer roller 20, a sheet P fed from the sheet feeding device 140 (described below) enters.

The secondary transfer roller 20 collectively transfers the visible images superposed on the intermediate transfer belt 18 to the sheet P. The transfer by the secondary transfer roller 20, for example, is performed by the potential difference between the secondary transfer roller 20 and the driving roller 19.

The fixing section 130B heats and presses the visible images transferred onto the sheet P, thereby fixing the visible images to the sheet P.

The sheet discharge section 130C discharges the sheet P with the visible images fixed by the fixing section 130B.

The sheet feeding device 140 stores the sheet P which is used for the image formation in the printer unit 130.

As illustrated in FIG. 1, the sheet feeding device 140 includes cassette sheet feeding devices 140B and 140C and a sheet conveying device 140A.

The cassette sheet feeding device 140B includes a cassette tray 140*b*. The cassette tray 140*b* can be drawn out in the x-axis positive direction from the storage state illustrated in FIG. 1.

As illustrated in FIG. 3, inside the cassette tray 140*b*, a sheet feeding tray 39A is disposed. The sheet feeding tray 39A stores a sheet bundle B3. In the sheet feeding tray 39A in a state in which the cassette tray 140*b* has been drawn out, the sheet bundle B3 is horizontally placed.

The sheet bundle B3 is configured by stacking one type of sheet P3 in a plural number. For example, the paper size of the sheet bundle B3 may be A3.

The sheet feeding tray 39A includes a tray bottom plate 39*c*, a pressure plate 39*a*, an end fence 39*e*, and side fences 39*f*.

The tray bottom plate 39*c* horizontally supports the sheet bundle B3.

The pressure plate 39*a* supports a lower end surface at a y-axis positive direction side of the sheet bundle B3 placed in the sheet feeding tray 39A. The pressure plate 39*a* is swingable around a rotating shaft 39*b* parallel to x axis. The pressure plate 39*a* is urged in the z-axis positive direction by an urging member (not illustrated) in the storage state of the cassette tray 140*b*. An end at the y-axis positive direction side of the sheet bundle B3 stored in the sheet feeding tray 39A is pushed by the pressure plate 39*a* up to a position at which sheet feeding can be carried out when the cassette tray 140*b* is in the storage state.

The end fence 39*e* is vertically positioned at an end at a y-axis negative direction side of the tray bottom plate 39*c*. The end fence 39*e* regulates the position in the y axis direction of the end at the y-axis negative direction side of the sheet bundle B3.

The side fences 39*f* are respectively vertically positioned at an end at an x-axis positive direction side and an end at an x-axis negative direction side of the tray bottom plate 39*c*. FIG. 3 illustrates the side fence 39*f* vertically positioned at the end at the x-axis negative direction side.

Each side fence 39*f* regulates the position in the x axis direction of both ends of the sheet bundle B3 in the x axis direction.

Inside the cassette sheet feeding device 140B, a pick-up roller 35B and a sheet feeding roller 34B are disposed at an upper part of the cassette tray 140*b* at the y-axis positive direction side.

The pick-up roller 35B moves the uppermost sheet P3 of the sheet bundle B3 in the y-axis positive direction.

The sheet feeding roller 34B separates the sheet P3 forming the uppermost surface of the upper sheets P3 of the sheet bundle B3. The sheet feeding roller 34B sends the separated sheet P3 to a conveying guide 38*a* in the cassette tray 140*b*. The sheet P3 is turned in the z-axis positive direction along the conveying guide 38*a* and then is conveyed to a conveyance path (not illustrated).

As illustrated in FIG. 1, the cassette sheet feeding device 140C is disposed below the cassette sheet feeding device 140B while overlapping the cassette sheet feeding device 140B.

The cassette sheet feeding device 140C includes a cassette tray 140*c*. The cassette tray 140*c* can be drawn out in the x-axis positive direction from the storage state illustrated in FIG. 1. The cassette tray 140*c* stores a bundle of sheets of one size therein. The size of the sheets in the cassette tray 140*c* may be identical to or different from that of sheets in the cassette tray 140*b*.

Inside the cassette sheet feeding device 140C, for example, a pick-up roller (not illustrated) and a sheet feeding roller (not illustrated), which are similar to the pick-up roller 35B and the sheet feeding roller 34B of the cassette sheet feeding device 140B, are disposed at an upper part of the cassette tray 140*c* at the y-axis positive direction side. The sheets in the cassette tray 140*c* are conveyed to a conveyance path (not illustrated) by the pick-up roller and the sheet feeding roller.

The sheet conveying device 140A is disposed below the printer unit 130 and above the cassette sheet feeding device 140B.

The sheet conveying device 140A includes a cassette tray 140*a*. The cassette tray 140*a* can be drawn out in the x-axis positive direction from the storage state illustrated in FIG. 1.

As illustrated in FIG. 3, inside the cassette tray 140*a*, two sheet bundles B1 and B2 can be stored.

The sheet bundles B1 and B2 are respectively configured by stacking one type of sheets P1 and P2 in a plural number. The paper types, the paper sizes, and the stacking numbers of the sheets P1 and P2 in the sheet bundles B1 and B2 may be identical to each other or different from each other.

Hereinafter, a description will be provided for a case where the paper types of the sheets P1 and P2 are different from each other and the paper sizes of the sheets P1 and P2 are identical to each other unless specifically stated otherwise.

The paper types of the sheets P1 and P2, for example, are decided according to a combination of characteristics of a material, a thickness, a surface property, and the like. The paper types may affect sheet feeding performance. Particularly, when adhesion among the sheets is high or when friction among the sheets is large to the extent that separation capacity of the sheet feeding device is exceeded, multi-feeding is likely to occur in the sheet feeding device. Depending on the paper types, the adhesion and friction among the sheets differ due to a storage condition and the like. For example, when a sheet with a high hygroscopicity is stored in a high humidity environment, multi-feeding is likely to occur.

In the case of using a sheet of a type that is likely to cause multi-feeding, before a sheet bundle is set in a tray, it is recommended to separate the sheet bundle.

The "separating of the sheet bundle" or "separating" represents that external force is applied to the sheet bundle B in order to reduce adhesion among the sheets in the sheet bundle.

In the "separating", it is necessary to allow stacked sheets of the sheet bundle to relatively slide by at least external force (hereinafter, "first type of separating"). Moreover, in the "separating", it is more preferable to temporarily separate the stacked sheets at an end of the sheet bundle in the sheet feeding direction (hereinafter, "second type of separating").

The separating is manually performed by a user of the image forming apparatus in many cases. In the present embodiment, the sheet bundle B1 stored in an auxiliary tray (described below) can be automatically separated by a separating unit 38 (described below).

The paper type of the sheet bundle B1 is a paper type in which the separating is preferably performed. As the paper type in which the separating is preferably performed, for example, there are a coarse paper, a paper that tends to be electrically charged, and the like.

In contrast, the paper type of the sheet bundle B2 is a paper type in which the separating need not be performed. As the paper type (which will be described later) in which the separating may not be preferably performed, for example, there are a paper, which is recommended by each multi-function peripherals (MFP) manufacturer, and the like. However, it is also preferable to perform the separating in the exemplified paper type. Particularly, there is a case where the separating is preferably performed in the exemplified paper type depending on a storage condition and the like.

The paper sizes of the sheet bundles B1 and B2 are sizes in which the sheet bundles B1 and B2 can be disposed adjacent to each other in the cassette tray 140*a* in a horizontal direction along y axis. For example, the paper sizes of the sheet bundles B1 and B2 may be A4. In such a case, the sheet bundles B1 and B2 are disposed in an orientation that the longitudinal direction of each sheet faces the x axis direction.

In the cassette tray 140*a*, a sheet feeding tray unit 31 and the auxiliary tray 32 are provided in this order in the y-axis negative direction. The sheet feeding tray 31 and the auxiliary tray 32 are adjacent to each other in the horizontal direction.

The sheet feeding tray 31 and the auxiliary tray 32 can store the sheet bundle B1 therein. The sheet feeding tray 31 and the auxiliary tray 32 can store the sheet bundle B2 therein.

The sheet feeding tray 31 includes a sheet feeding tray 31A, a pick-up roller 35A, and a sheet feeding roller 34A.

The sheet feeding tray 31A can store any one of the sheet bundles B1 and B2. Hereinafter, the sheet bundles B1 and B2 will be described as the sheet bundle B when there is no meaning in distinguishing them.

In the sheet feeding tray 31A in a state in which the cassette tray 140*a* has been drawn out, the sheet bundle B is horizontally placed.

The sheet feeding tray 31A includes a tray bottom plate 31*c*, a pressure plate 31*a*, side fences 31*f*, and end fences 31*e*.

The tray bottom plate 31*c* horizontally supports the sheet bundle B. At an end edge at the y-axis negative direction side of the tray bottom plate 31*c*, an inclined surface 31*d* is formed and inclined toward the z-axis negative direction as it goes to the y-axis negative direction.

The pressure plate 31*a* supports a lower end surface at the y-axis positive direction side of the sheet bundle B placed in the sheet feeding tray 31A. The pressure plate 31*a* is swingable around a rotating shaft 31*b* parallel to x axis. The pressure plate 31*a* is urged in the z-axis positive direction by an urging member (not illustrated) in the storage state of the cassette tray 140*a*. An end at the y-axis positive direction side of the sheet bundle B stored in the sheet feeding tray 31A is pushed by the pressure plate 31*a* up to a position, in which sheet feeding is possible, in the storage state of the cassette tray 140*a*.

As illustrated in FIG. 4, at a center in the x axis direction on the surface of an end at the y-axis positive direction side of the pressure plate 31*a*, a sheet feeding pad 31*g* is provided to increase frictional force with the lowermost surface of the sheet bundle B.

As illustrated in FIG. 4, the side fences 31*f* are respectively vertically provided at an end at an x-axis positive direction side and an end at an x-axis negative direction side of the tray bottom plate 31*c*. An interval between the side fences 31*f* in the x axis direction is identical to a paper width of the sheet bundle B in the x axis direction. Each side fence 31*f* regulates the position in the x axis direction of both ends in the x axis direction of the sheet bundle B.

The end fences 31*e* are respectively provided in the vicinity of ends at the y-axis negative direction side of the side fences 31*f*. Each end fence 31*e* is provided to be advanced or retracted in an inside space interposed between the side fences 31*f* from an outside of the side fence 31*f* in the vicinity thereof. The end fences 31*e* are disposed on the same plane parallel to the zx plane.

In FIG. 4, a position of each end fence 31*e* at the time of advance is drawn by a solid line and a position of each end fence 31*e* at the time of retraction is drawn by a two dot chain line. Between leading ends 31*h* of the end fences 31*e* in the advance direction, an opening 31*i* (a second opening) is formed at the y-axis negative direction side of the sheet feeding tray 31A. An opening width of the opening 31*i* in they axis direction at the time of advance of each end fence 31*e* is smaller than a width in the longitudinal direction of the sheet bundle B. At the time of retraction of each end fence 31*e*, the opening 31*i* is formed between the ends at the y-axis negative direction side of the side fences 31*f*. An opening width of the opening 31*i* at the time of retraction of each end fence 31*e* is a width through which the sheet bundle B can pass in the y axis direction, wherein the width in the longitudinal direction of the sheet bundle B faces the x axis direction.

An end fence driving section 51 is connected to each end fence 31*e*.

The end fence driving section 51 advances or retracts each end fence 31*e* based on a control signal from a sheet feeding and conveying control section 97 (described below).

As illustrated in FIG. 3, inside the sheet feeding tray 31, the pick-up roller 35A and the sheet feeding roller 34A are disposed at an upper part of the cassette tray 140*a* at the y-axis positive direction side.

The pick-up roller 35A moves the uppermost sheet of the sheet bundle B in the y-axis positive direction.

The sheet feeding roller 34A is disposed to add a conveyance force and a separation force to the center in the x axis direction of the sheet bundle B moved by the pick-up roller 35A. The sheet feeding roller 34A separates a sheet forming the uppermost surface of the upper sheets of the sheet bundle B. The sheet feeding roller 34A sends the separated sheet to a conveying guide 33*a* in the cassette tray 140*a*. The sheet is turned in the z-axis positive direction along the conveying guide 33*a* and then is conveyed to a conveyance path (not illustrated).

The pick-up roller 35A and the sheet feeding roller 34A can use configurations similar to those of the pick-up roller 35B and the sheet feeding roller 34B in the cassette sheet feeding devices 140B, respectively.

Below (corresponding to the z-axis negative direction) the tray bottom plate 31*c*, an empty sensor 40 (a second sensor) is disposed. The empty sensor 40 detects an empty state of the sheet feeding tray 31. The tray bottom plate 31*c* above (corresponding to the z-axis positive direction) the empty sensor 40 is formed with a detection opening 31*j* (see FIG. 4).

The configuration of the empty sensor 40 is not particularly limited as long as it is possible to determine whether the sheet bundle B is placed on the tray bottom plate 31*c*. For example, as the empty sensor 40, it may be possible to use a mechanical sensor having a detection lever (not illustrated) that is advanced or retracted through the detection opening 31*j* and an optical sensor that detects an operation of the detection lever. For example, as the empty sensor 40, it may be possible to use an optical sensor that optically detects the presence or absence of the sheet bundle B through the detection opening 31*j*.

Above the tray bottom plate 31*c*, a position sensor 41 is disposed. The position sensor 41 detects a state where a movement tray 32B in the auxiliary tray 32 is in an advanced position in the sheet feeding tray 31.

The configuration of the position sensor 41 is not particularly limited as long as it is possible to detect a position of the movement tray 32B. For example, as the position sensor 41, an optical sensor and the like may be used.

The arrangement position of the position sensor 41 is not particularly limited as long as it is possible to detect the position of the movement tray 32B.

As illustrated in FIG. 3, the auxiliary tray 32 includes a storage tray 32A.

The storage tray 32A can store any one of the sheet bundles B1 and B2. In the storage tray 32A, the sheet bundle B is horizontally placed.

The storage tray 32A includes the movement tray 32B, a slider 32*d*, and side fences 32*f*.

The movement tray 32B includes a sheet placing plate 32*a* and an extruding plate 32*c* (an extruding member).

The sheet placing plate 32*a* horizontally supports the sheet bundle B. A lower surface (a surface at the z-axis negative direction side) of the sheet placing plate 32*a* is disposed to have a height approximately level with the uppermost part on the surface at the z-axis positive direction side of the tray bottom plate 31*c*. The sheet placing plate 32*a* is supported on a support board (not illustrated) so as to be movable in the y axis direction. A movement range of the sheet placing plate 32*a* is from a home position of the auxiliary tray 32 illustrated in FIG. 3 to the advanced position of the sheet feeding tray 31 overlapping the tray bottom plate 31*c* and the pressure plate 31*a*.

As illustrated in FIG. 4, an external appearance of the sheet placing plate 32*a* in the plan view is an approximately rectangular shape. At both corners in the x axis direction at end edges at the y-axis positive direction side of the sheet placing plate 32*a*, inclined edge parts 32*g* are respectively formed.

Each of the inclined edge parts 32*g* has a C-chamfered shape inclined with respect to an axis line, which is parallel to x axis, by about 45°.

In the sheet placing plate 32*a*, a width in the x axis direction, except for the inclined edge parts 32*g*, is slightly smaller than the width in the longitudinal direction of the sheet bundle B. In the sheet placing plate 32*a*, a width in the y axis direction, except for the inclined edge parts 32*g*, is larger than the width in the short direction of the sheet bundle B.

Both ends in the x axis direction of the end at the y-axis positive direction side of the sheet bundle B placed on the sheet placing plate 32*a* are overhung from each sheet placing plate 32*a*.

In the sheet placing plate 32*a*, a through hole 32*b* is formed at a center in the x axis direction, which is closer to the y-axis positive direction. The through hole 32*b* passes through the sheet placing plate 32*a* in the thickness direction of the sheet placing plate 32*a*. In the present embodiment, in the sheet placing plate 32*a*, a position of the through hole 32*b* in the y axis direction is closer to the y-axis negative direction than the inclined edge parts 32*g* as an example.

The shape and size of the through hole 32*b* correspond to a size in which at least apart of a first contact-separation member 36A (described below) can be advanced or retracted in the z axis direction.

In the sheet placing plate 32*a*, a detection opening 32*h* is formed in an area where the sheet bundle B is placed. The detection opening 32*h* is provided for detection of an empty sensor 42 (described below). A formation position of the detection opening 32*h* is not particularly limited as long as the empty sensor 42 can perform a detection operation at the home position of the sheet placing plate 32*a*. In the example illustrated in FIG. 4, the detection opening 32*h* is formed at a position closer to the sheet placing plate 32*a* in the y-axis negative direction and the x-axis negative direction.

An upper surface (a surface at the z-axis positive direction side) of the sheet placing plate 32*a* is formed with a material and a shape having superior slipperiness with the sheets of the sheet bundle B. The lower surface of the sheet placing plate 32*a* is formed with a material and a shape having superior slipperiness with the surfaces of the tray bottom plate 31*c* and the pressure plate 31*a*.

For example, in at least one of the upper surface and the lower surface of the sheet placing plate 32*a*, a bead (a beading rib, not illustrated) may be formed to extend in the y axis direction. For example, in an advanced position of the sheet placing plate 32*a*, an escaping part or a notched part (not illustrated), which does not contact the sheet feeding pad 31*g*, may be formed at a part of the sheet placing plate 32*a*, which overlaps the sheet feeding pad 31*g*.

As illustrated in FIG. 3, the extruding plate 32*c* is vertically provided at an end at the y-axis negative direction side of the sheet placing plate 32*a*. The extruding plate 32*c* regulates the position in the y axis direction of the end at the y-axis negative direction side of the sheet bundle B on the storage tray 32A. When the sheet placing plate 32*a* moves, the extruding plate 32*c* moves together with the sheet placing plate 32*a*.

The extruding plate 32*c* is provided to be abuttable to a part or the whole of an end surface E1 (a first end) at the y-axis negative direction side of the sheet bundle B. In the example illustrated in FIG. 4, the extruding plate 32*c* is provided to be abuttable to a part of the end surface of the sheet bundle B at an intermediate part thereof in the x axis direction. An abutting width between the extruding plate 32*c* and the sheet bundle B in the x axis direction is not particularly limited as long as it can prevent a compression stain, a crack, and the like in the end surface E1 of the sheet bundle B due to pressing force on the sheet bundle B from the extruding plate 32*c*.

The slider 32*d* is a member that transfers external force for moving the movement tray 32B in the y axis direction to the movement tray 32B. The slider 32*d* is provided to be reciprocally movable in the y axis direction along a guide part (not illustrated).

An arrangement position of the slider 32*d* is not particularly limited as long as it is possible to transfer external force to the movement tray 32B. In the example illustrated in FIGS. 3 and 4, the slider 32*d* is provided below the extruding plate 32*c* and is fixed to the lower surface of the sheet placing plate 32*a*. A position of the slider 32*d* in the x axis direction is a center of the sheet placing plate 32*a* in the x axis direction.

As illustrated in FIG. 4, a slider driving section 52 is connected to the slider 32*d*.

The slider driving section 52 moves the slider 32*d* in accordance with the control signal from the sheet feeding and conveying control section 97.

For example, as a configuration example of the slider driving section 52, there is a wire driving mechanism including a driving wire and a driving motor for driving the driving wire. For example, as a configuration example of the slider driving section 52, there is a belt driving mechanism including a driving belt, a driving motor for driving the driving belt, and the like.

The movement tray 32B and the slider driving section 52 constitute a sheet bundle moving part that moves the sheet bundle B from the auxiliary tray 32 to the sheet feeding tray 31.

As illustrated in FIG. 4, the side fences 32*f* are provided at two positions interposing the sheet placing plate 32*a* therebetween in the home position. Each side fence 32*f* is fixed to the cassette tray 140*a* or a fixed member (not illustrated) fixed to the cassette tray 140*a*.

An interval of the side fences 32*f* in the x axis direction is identical to the paper width of the sheet bundle B in the x axis direction. Each side fence 32*f* regulates the position in the x axis direction of both ends of the sheet bundle B in the x axis direction placed on the sheet placing plate 32*a* at the home position.

The side fence 32*f* at the x-axis positive direction side is aligned with the side fence 31*f* of the sheet feeding tray 31 at the x-axis positive direction side on the same plane. The side fence 32*f* at the x-axis negative direction side is aligned with the side fence 31*f* at the x-axis negative direction side on the same plane.

Between the ends at the y-axis positive direction side of the side fences 32*f*, an opening 32*i* (a first opening) at the y-axis positive direction side is formed in the storage tray 32A. An opening width of the opening 32*i* is a width through which the sheet bundle B placed on the sheet placing plate 32*a* can pass in the y axis direction.

As illustrated in FIG. 3, in the auxiliary tray 32, the empty sensor 42 (a first sensor) is disposed below the sheet placing plate 32*a* in the home position. When the sheet placing plate 32*a* is in the home position, the empty sensor 42 detects the empty state of the auxiliary tray 32. In the present embodiment, the empty sensor 42 detects the presence or absence of the sheet bundle B through the detection opening 32*h* (see FIG. 4) of the sheet placing plate 32*a* positioned in the home position.

The configuration of the empty sensor 42 is not particularly limited as long as it is possible to determine whether the sheet bundle B is placed on the sheet placing plate 32*a*. For example, the empty sensor 42 may have a configuration similar to that exemplified as a preferable example of the empty sensor 40.

Above the sheet placing plate 32*a* in the home position, a position sensor 43 is disposed. The position sensor 43 detects a state where the movement tray 32B is in the home position in the auxiliary tray 32.

The configuration of the position sensor 43 is not particularly limited as long as it is possible to detect the position of the movement tray 32B. For example, as the position sensor 43, an optical sensor and the like may be used.

The arrangement position of the position sensor 43 is not particularly limited as long as it is possible to detect the position of the movement tray 32B.

As illustrated in FIG. 3, the cassette tray 140*a* further includes the separating unit 38. The separating unit 38 is a unit that separates the sheet bundle B stored in the auxiliary tray 32.

In the present embodiment, the separating unit 38 includes the first contact-separation member 36A (a position regulating unit), a second contact-separation member 36B (a position regulating unit), and a pressing member 37 (a rotating roller).

The first contact-separation member 36A is disposed below the sheet placing plate 32*a* of the movement tray 32B in the home position.

As illustrated in FIG. 4, the first contact-separation member 36A includes a contact-separation unit 36*a* and an arm 36*b*.

The contact-separation unit 36*a* is positioned in an inner range of the through hole 32*b* in the plan view. The contact-separation unit 36*a* is provided to be advanced or retracted from below with respect to the through hole 32*b*.

As illustrated in FIG. 3, when the contact-separation unit 36*a* has been advanced in foremost (a first abutting position, see a two dot chain line), the contact-separation unit 36*a* abuts a lower surface S1 (a first surface) of the sheet bundle B. When the contact-separation unit 36*a* has been retracted in rearmost (a first retracted position, see a solid line), the contact-separation unit 36*a* is separated from the sheet bundle B. Moreover, when the arm 36*b* has been retracted in rearmost, there is no interference with the movement tray 32B even though the movement tray 32B moves in the y axis direction.

A shape of the contact-separation unit 36*a* is not particularly limited as long as it is possible to abut the lower surface S1 of the sheet bundle B and thus to regulate the position of the sheet bundle B at the abutting part in the z-axis negative direction. In the present embodiment, as an example, the contact-separation unit 36*a* is a circular column extending in the x axis direction.

As a material of the contact-separation unit 36*a*, for example, resin, rubber, a metal, and the like may be used.

As illustrated in FIG. 4, the arm 36*b* supports the contact-separation unit 36*a* so as to be movable in the z axis direction. In the present embodiment, the arm 36*b* is connected to an end of the contact-separation unit 36*a* at the x-axis negative direction side. The arm 36*b* extends in the x-axis negative direction.

The arm 36*b* is connected to an arm driving section 53.

The arm driving section 53 moves the arm 36*b* in the z axis direction in accordance with the control signal from the sheet feeding and conveying control section 97.

A distance from the first retracted position to the first abutting position is constant. The arm driving section 53 can reciprocally drive the first contact-separation member 36A between the first retracted position and the first abutting position.

As illustrated in FIG. 3, the second contact-separation member 36B is disposed above the movement tray 32B in the home position. The second contact-separation member 36B includes a contact-separation unit 36*a* and an arm 36*b* including members similar to those of the contact-separation unit 36*a* and the arm 36*b* of the first contact-separation member 36A.

The contact-separation unit 36*a* of the second contact-separation member 36B is disposed above the movement tray 32B to face the contact-separation unit 36*a* of the first contact-separation member 36A.

The contact-separation unit 36*a* of the second contact-separation member 36B is provided so as to be advanced or retracted toward an upper surface S2 (a second surface) of the sheet bundle B in the storage tray 32A from an upper side of the movement tray 32B. The contact-separation unit 36*a* of the second contact-separation member 36B is advanced to a position (a second abutting position) abutting the upper surface S2 according to the stacking number of the sheet bundle B in the storage tray 32A (see a two dot chain line). When the contact-separation unit 36*a* of the second contact-separation member 36B starts to be retracted, the contact-separation unit 36*a* of the second contact-separation member 36B is separated from the sheet bundle B. Moreover, when the contact-separation unit 36*a* of the second contact-separation member 36B has been retracted in rearmost (a second retracted position, see a solid line), the contact-separation unit 36*a* of the second contact-separation member 36B does not interfere with the movement tray 32B even though the movement tray 32B moves in the y axis direction.

The arm 36*b* of the second contact-separation member 36B supports the contact-separation unit 36*a* of the second contact-separation member 36B so as to be movable in the z axis direction. A movement range of the arm 36*b* of the second contact-separation member 36B is a range in which the contact-separation unit 36*a* of the second contact-separation member 36B can move in the aforementioned movement range. Similarly to the arm 36*b* of the first contact-separation member 36A, the arm 36*b* of the second contact-separation member 36B is connected to the arm driving section 53 (not illustrated).

The arm driving section 53 also moves the arm 36*b* of the second contact-separation member 36B in the z axis direction in accordance with the control signal from the sheet feeding and conveying control section 97.

A distance from the second retracted position to the second abutting position varies according to the stacking amount of the sheet bundle B. In relation to the driving of the second contact-separation member 36B, the arm driving section 53 is configured to be able to reciprocally drive the second contact-separation member 36B between the second retracted position and the second abutting position even in a case where there is a change in the second abutting position.

For example, the arm driving section 53 may have a contact detection sensor for detecting contact with the upper surface S2 or a height sensor for detecting a height of the upper surface S2 reaching a certain height. In such a case, on the basis of detection output of the contact detection sensor or the height sensor, the driving is stopped at a contact position between the contact-separation unit 36*a* and the upper surface S2.

For example, when the contact-separation unit 36*a* abuts the upper surface S2, the arm driving section 53 may have a limiter through which transfer of driving force in the z-axis negative direction is stopped.

As illustrated in FIG. 4, the pressing member 37 includes a rotating shaft 37*b* and rollers 37*a*.

The rotating shaft 37*b* is disposed in parallel to x axis. The rotating shaft 37*b* has a length exceeding the width in the longitudinal direction of the sheet bundle B. In the plan view, the rotating shaft 37*b* is disposed between an end surface E2 opposite to the end surface E1 of the sheet bundle B and the sheet feeding tray 31.

A pressing member driving section 54 (described below) is connected to an end at the x-axis negative direction side of the rotating shaft 37*b* via an appropriate transfer mechanism.

The rotating shaft 37*b* receives a driving force from the pressing member driving section 54, and thus can reciprocally move in the z axis direction of the rotating shaft 37*b* and can rotate around a center shaft line of the rotating shaft 37*b*.

The rollers 37*a* are fixed to the rotating shaft 37*b* at two places separated in the longitudinal direction of the rotating shaft 37*b*. In the plan view, the rollers 37*a* are disposed at positions facing, in the y axis direction, the inclined edge parts 32*g* of the auxiliary tray 32 in the home position.

An external appearance of each roller 37*a* is a columnar shape coaxial with the rotating shaft 37*b*. An outer diameter of each roller 37*a* is larger than a distance between the center shaft line of the rotating shaft 37*b* and the end surface E2 of the sheet bundle B placed in the movement tray 32B positioned in the home position.

A material of each roller 37*a* is not particularly limited if it prevents a compression stain, a crack, and the like from occurring in a second end including the end surface E2 of the sheet bundle B at the time of contact with the sheet bundle B. Preferably, the material of each roller 37*a* has large friction with the end surface E2.

For example, preferably, as the material of each roller 37*a*, at least the surface is formed with resin, elastomer, and the like.

The surface of each roller 37*a* maybe formed with a rough surface, a concave-convex, surface and the like in order to increase friction with the sheet bundle B. As an example of the concave-convex surface, for example, there is a shape in which a plurality of protrusions having a partial spherical shape, a needle shape, a brush shape, and the like protrude from a cylindrical surface. As an example of the concave-convex surface, for example, there is a shape in which a plurality of dimples recessed in a partial spherical shape from a cylindrical surface are distributed.

As an example of the concave-convex surface, for example, there is a shape in which a plurality of projection bars extend in a circumferential direction on a cylindrical surface and are separated from one another in an axial direction. As an example of the concave-convex surface, for example, there is a shape in which a plurality of projection bars extend in an axial direction on a cylindrical surface and are separated from one another in a circumferential direction. At the concave-convex surface provided thereon with a plurality of projection bars, the cross-sectional shape of the projection bar, for example, may be rectangular, triangular, a U shape, and the like.

The pressing member driving section 54 moves the rotating shaft 37*b* up and down in the z axis direction, thereby moving the pressing member 37 up and down in the z axis direction. The up and down range of the pressing member 37 are two positions (see the solid line and the two dot chain line of FIG. 3), at which the pressing member 37 does not interfere with the movement tray 32B, even though the movement tray 32B moves in the y axis direction.

In the present embodiment, the lowermost position of the pressing member 37 below the movement tray 32B is a first waiting position of the pressing member 37 (see the solid line of FIG. 3). The pressing member driving section 54 can reciprocally move the pressing member 37 between the waiting position of the pressing member 37 and a second waiting position (see the two dot chain line of FIG. 3) above the movement tray 32B.

Moreover, at the time of the reciprocation, the pressing member driving section 54 rotates the rotating shaft 37*b* in two directions around the center shaft line of the rotating shaft 37*b*, thereby rotating the pressing member 37 forward and backward.

Hereinafter, when the rotating shaft 37*b* is viewed from the x-axis negative direction, rotation in a clockwise direction is referred to as a forward rotation (see the solid line arrow of FIG. 3) of the rotating shaft 37*b*. When the rotating shaft 37*b* is viewed from the x-axis negative direction, rotation in a counterclockwise direction is referred to as a backward rotation (see the two-dot chain line arrow of FIG. 3) of the rotating shaft 37*b*.

Next, a configuration example of a control system of the image forming apparatus 100 will be described.

Figure 5:
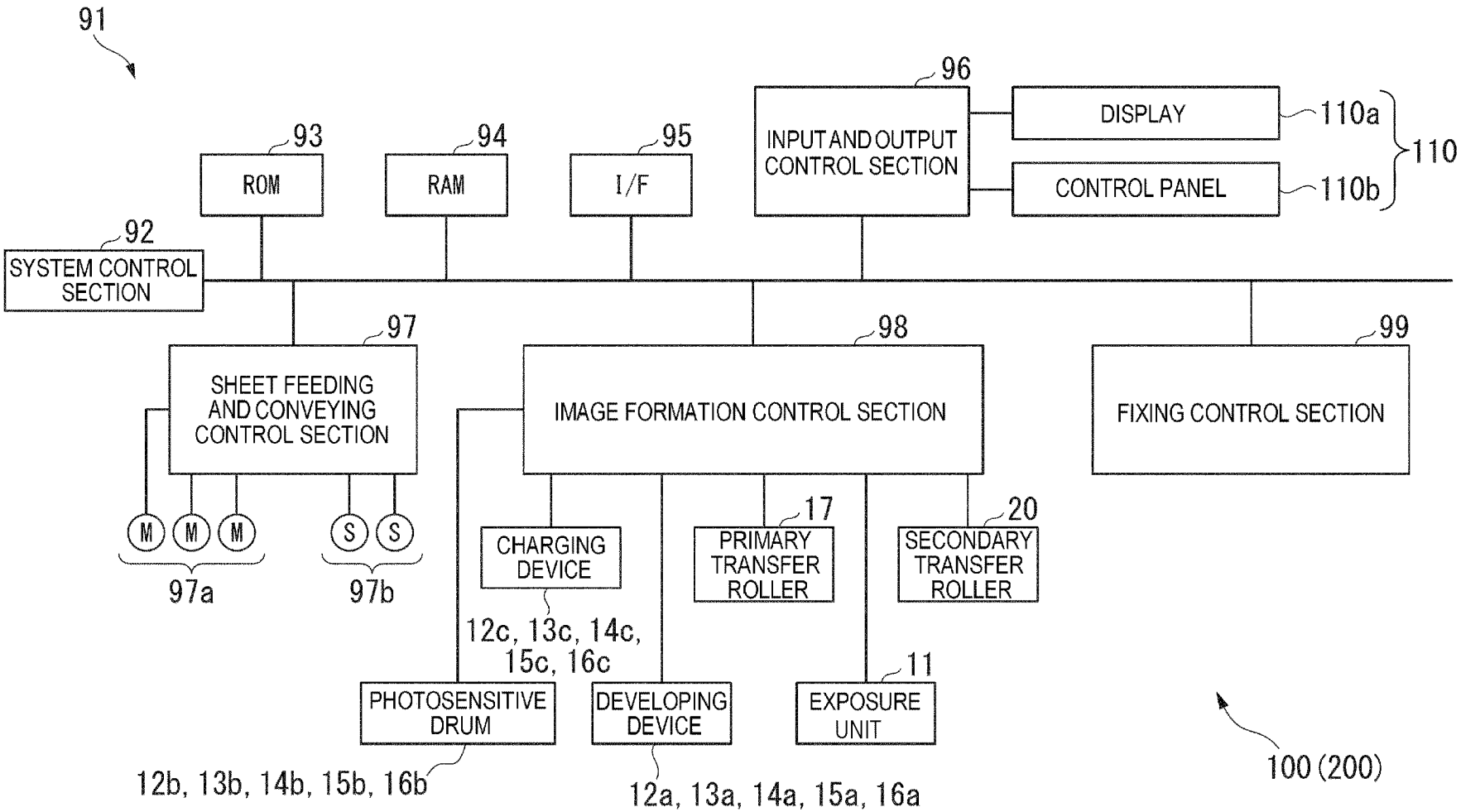
FIG. 5 is a block diagram of a control system of the image forming apparatus.

FIG. 5 is a block diagram illustrating a configuration example of a control system of the image forming apparatus according to the first embodiment.

As illustrated in FIG. 5, the image forming apparatus 100 includes a control unit 91.

The control unit 91 includes a system control section 92, a read only memory (ROM) 93, a random access memory (RAM) 94, an interface (I/F) 95, an input and output control section 96, the sheet feeding and conveying control section 97, the image formation control section 98, and a fixing control section 99.

The system control section 92 controls the entire image forming apparatus 100. The system control section 92 performs functions for processing image formation by executing programs stored in the ROM 93 or the RAM 94. As a hardware configuration of the system control section 92, for example, a processor such as a central processing unit (CPU) may be used.

The ROM 93 stores a control program for performing a basic operation of an image forming process, control data, and the like.

The RAM 94 is a working memory in the control unit 91. For example, the control program or the control data of the ROM 93 is loaded on the RAM 94. Moreover, the RAM 94 temporarily stores image data sent from the input and output control section 96 or data sent from the system control section 92.

The I/F 95 communicates with a connection device connected to the printer unit 130. For example, the scanner unit 120 is communicably connected to the I/F 95. Moreover, an external device can be connected to the I/F 95. As an example of the external device, there are a user terminal, a facsimile and the like.

The input and output control section 96 controls the operation unit 110 including the display 110*a* and the control panel 110*b*. The input and output control section 96 sends operation input received from the display 110*a* and the control panel 110*b* to the system control section 92.

The sheet feeding and conveying control section 97 controls driving systems included in the printer unit 130 and the sheet feeding device 140. For example, the driving system includes a plurality of driving sections 97*a* including a driving source (a driving motor, a solenoid and the like) for supplying driving force, a driving transfer unit such as a clutch, and the like. As an example of the driving section 97*a*, there is a driving motor that drives a registration roller included in the printer unit 130, the pick-up roller, the sheet feeding roller, both rollers being included in the sheet feeding device 140, and the like. As the driving sections 97*a*, there are the aforementioned end fence driving section 51, slider driving section 52, arm driving section 53, and pressing member driving section 54 included in the sheet conveying device 140A.

The sheet feeding and conveying control section 97 is communicably connected to the plurality of driving sections 97*a*.

A plurality of sensors 97*b* are electrically connected to the sheet feeding and conveying control section 97.

As an example of the sensor 97*b*, there are a plurality of sheet detection sensors included in the printer unit 130 and the sheet feeding device 140. Each sheet detection sensor detects the presence or absence of a sheet in a sensor arrangement position.

As an example of the sensor 97*b*, there are the aforementioned empty sensors 40 and 42 and position sensors 41 and 43 included in the sheet conveying device 140A.

The detection output of each sensor 97*b* is sent to the system control section 92 from the sheet feeding and conveying control section 97.

The sheet feeding and conveying control section 97 controls the driving sections 97*a* on the basis of a control signal from the system control section 92 and the detection output of the sensors 97*b*.

The image formation control section 98 controls the photosensitive drums 12*b*, 13*b*, 14*b*, 15*b*, and 16*b*, the charging devices 12*c*, 13*c*, 14*c*, 15*c*, and 16*c*, the exposure unit 11, the developing devices 12*a*, 13*a*, 14*a*, 15*a*, and 16*a*, the primary transfer rollers 17, and the secondary transfer roller 20 on the basis of the control signal from the system control section 92.

The fixing control section 99 controls a heating operation of the fixing section 130B on the basis of the control signal from the system control section 92.

Details of the control performed by the control unit 91 will be described together with the operation of the image forming apparatus 100.

Next, the operation of the image forming apparatus 100 of the present embodiment will be described while focusing on the operation of the sheet conveying device 140A.

Figure 6:
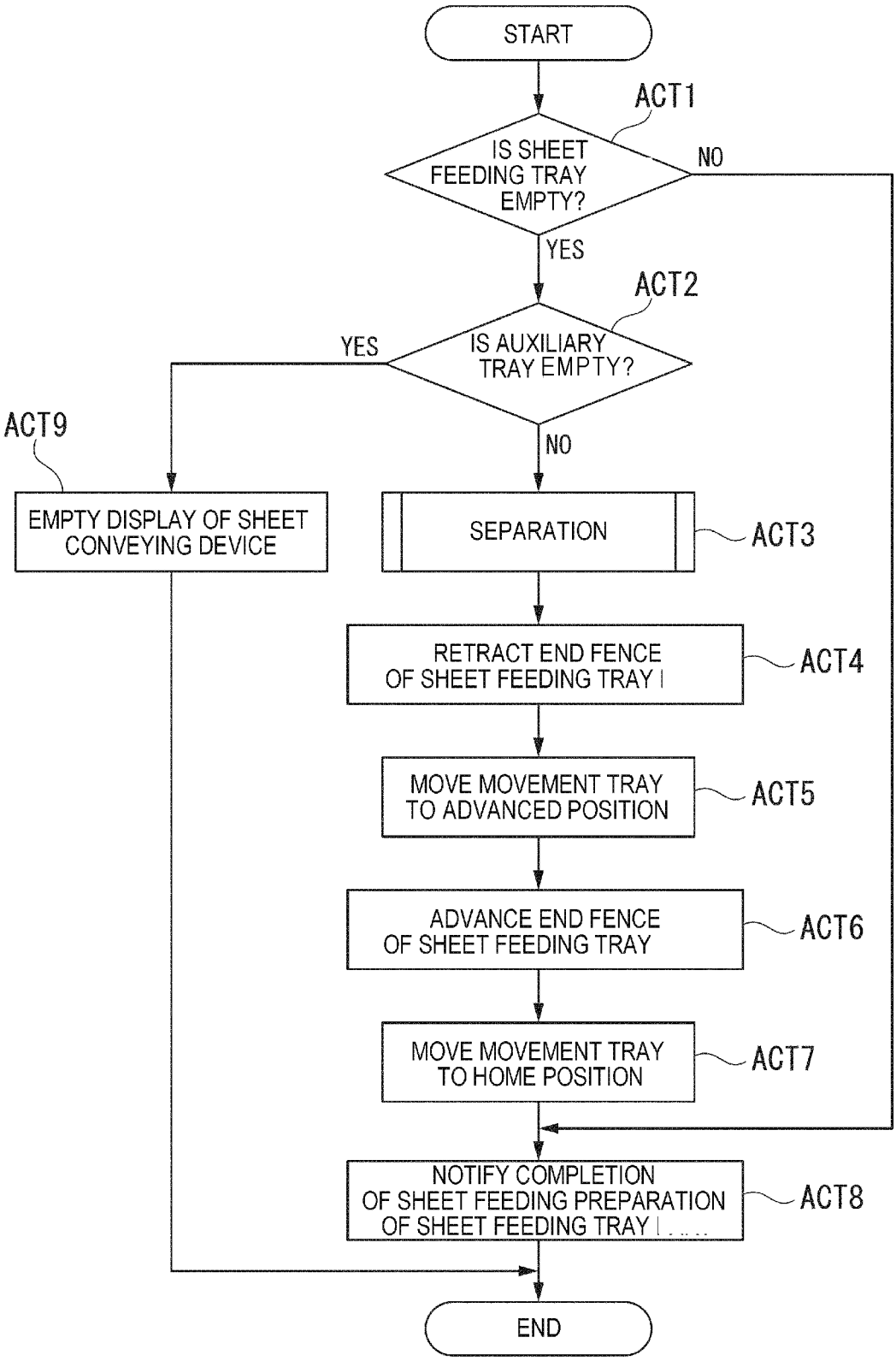
FIG. 6 is a flowchart of an operation of the sheet conveying device.
Figure 7:
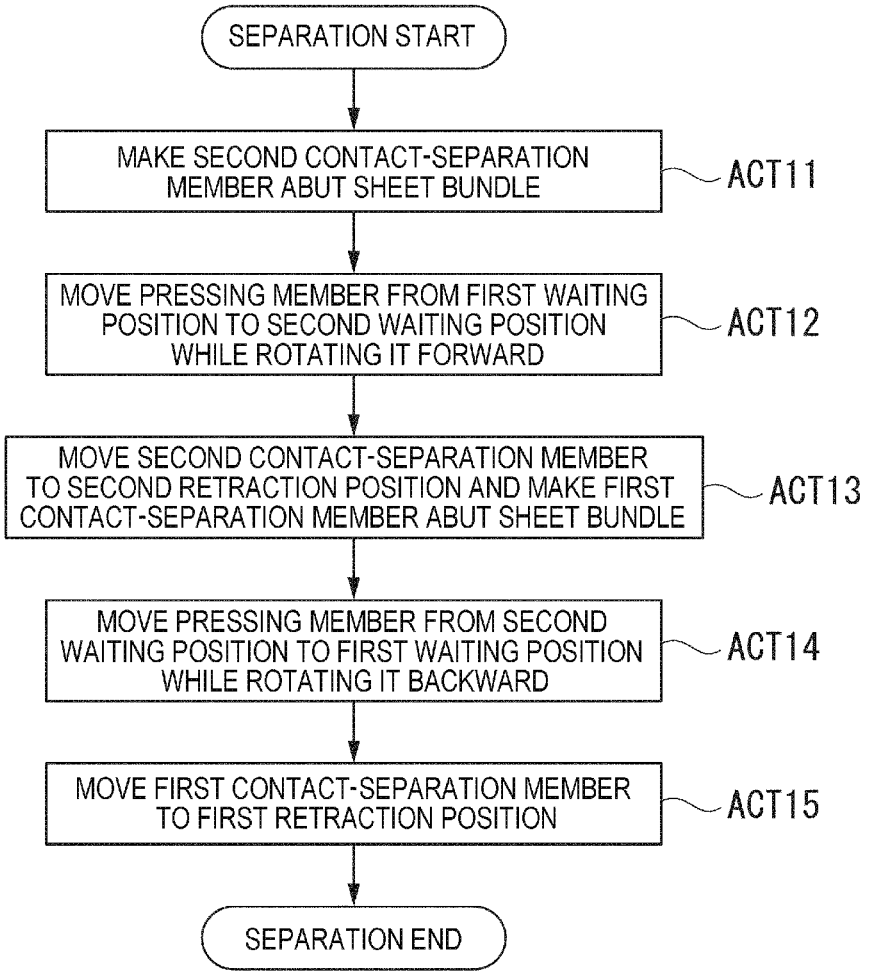
FIG. 7 is a flowchart of the operation of the sheet conveying device.
Figure 8:
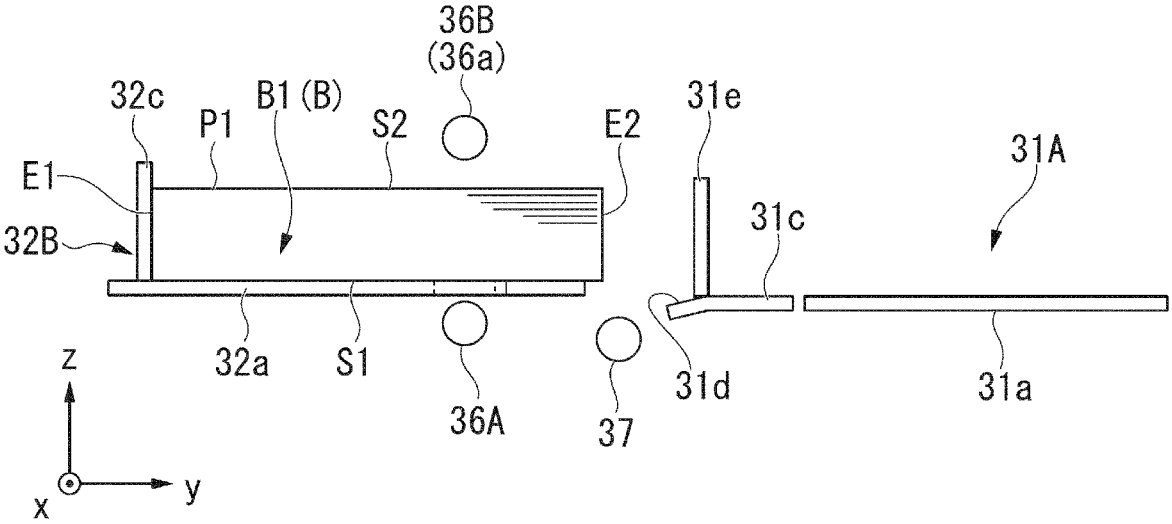
FIGS. 8-10 illustrate schematic cross-sectional views of the sheet conveying device to explain the operation of the sheet conveying device.
Figure 9:
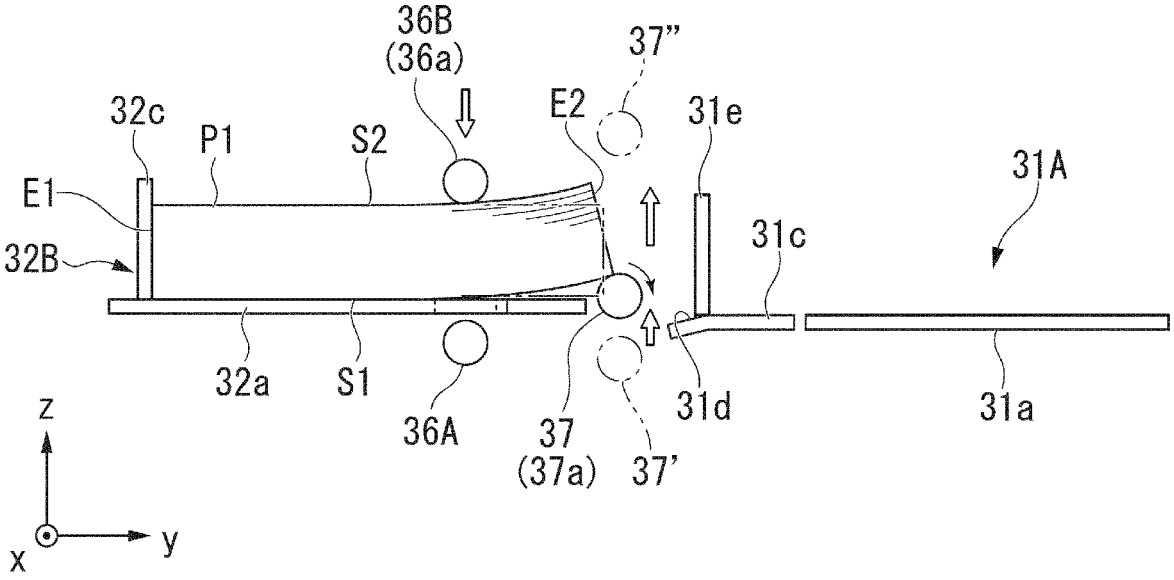
Figure 10:
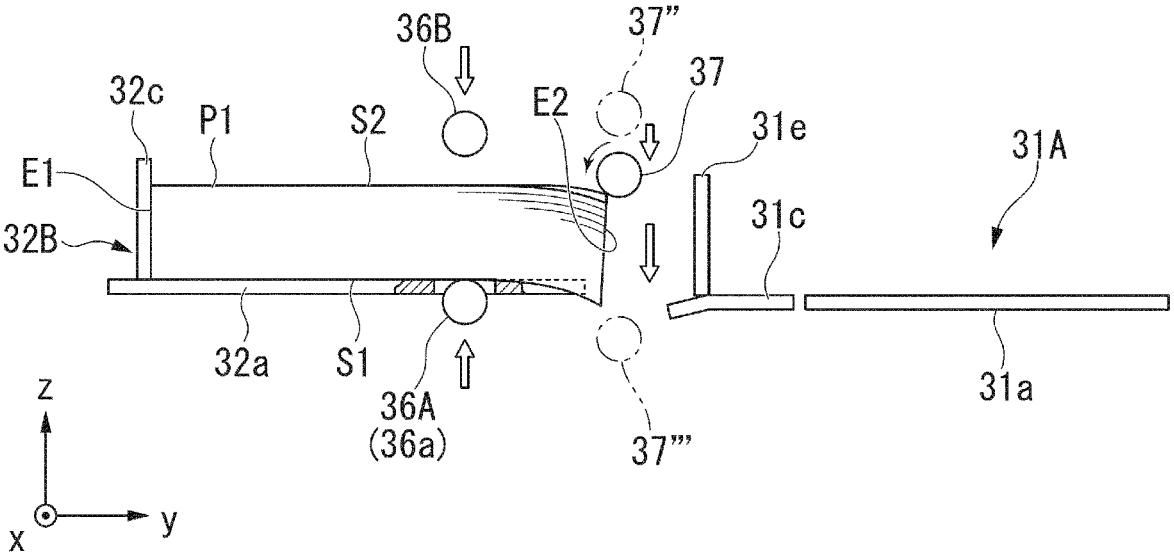
Figure 11:
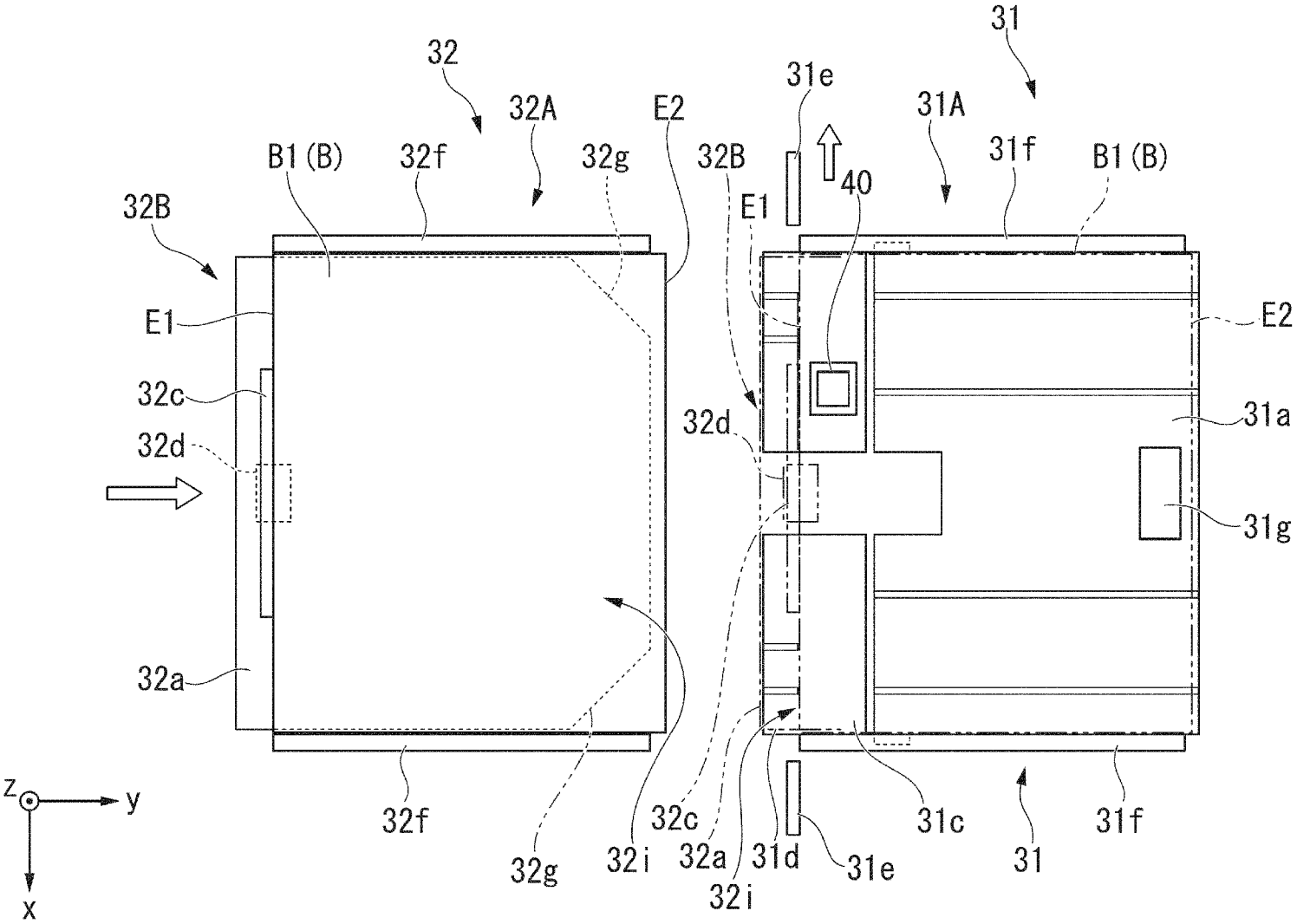
FIGS. 11 and 12 illustrate schematic plan views of the sheet conveying device to explain the operation of the sheet conveying device.
Figure 12:
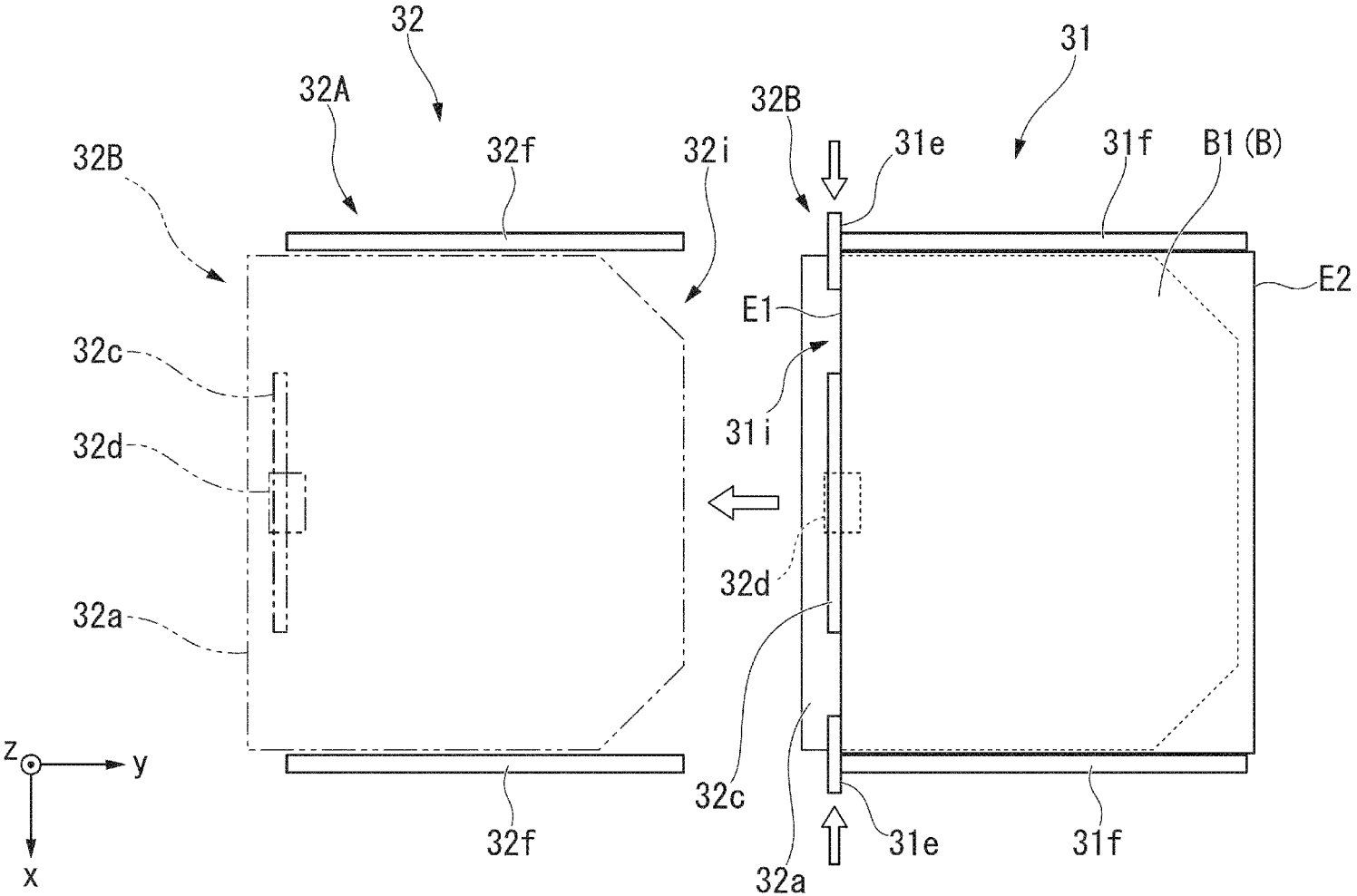

FIGS. 6 and 7 are flowcharts of the operation of the sheet conveying device according to the first embodiment. FIGS. 8 to 10 are cross-sectional views of the sheet conveying device according to the first embodiment to explain the operation thereof. FIGS. 11 and 12 are schematic plan views of the sheet conveying device to explain the operation thereof.

When image formation is performed by the image forming apparatus 100, a sheet to be subjected to the image formation is selected before printing starts. For example, an operator can select a sheet feeding device (including the sheet conveying device 140A) including the sheet to be subjected to the image formation (manual selection) through the operation unit 110. For example, when an image size, variable power information and the like are input to the system control section 92 from the scanner unit 120 or the external device through the I/F 95, the system control section 92 may select the sheet on the basis of the input information (automatic selection).

The sheet feeding and conveying control section 97 executes programs for performing a manual separating mode, an automatic separating mode, and a separating stop mode as control programs of the separating unit 38 in the sheet conveying device 140A. The control programs corresponding to the manual separating mode, the automatic separating mode, and the separating stop mode are switched by operation input through the operation unit 110 or the I/F 95.

In the manual separating mode, when a separating command is input from the operation unit 110, the sheet feeding and conveying control section 97 allows the separating unit 38 to perform a separating operation.

In the automatic separating mode, when the sheet bundle B is stored in the auxiliary tray 32 of the sheet conveying device 140A and it is necessary to move the sheet bundle B to the sheet feeding tray 31, the sheet feeding and conveying control section 97 allows the separating unit 38 to perform the separating operation. The sheet bundle B may need to be moved from the auxiliary tray 32 to the sheet feeding tray 31 when the sheet feeding tray part 31 is empty and a sheet feeding control signal is sent to the sheet feeding and conveying control section 97 from the sheet feeding tray 31.

In the separating stop mode, the sheet feeding and conveying control section 97 does not allow the separating unit 38 to perform a separating operation. The separating stop mode is a control mode particular available when only the sheet bundle B2 is stored in the sheet conveying device 140A. In the separating stop mode, it is possible to prevent the sheet bundle B requiring no separation from being separated.

In the manual separating mode, when the sheet bundle B2 is stored in the auxiliary tray 32, the separating unit 38 is allowed to perform a separating operation. Whether the sheet feeding tray 31 is empty is not important. In the manual separating mode, sheet feeding from the sheet conveying device 140A needs not to be selected.

In contrast, in the automatic separating mode, the sheet feeding from the sheet conveying device 140A needs to be selected by manual selection or automatic selection.

In the automatic separating mode, the sheet feeding and conveying control section 97 may prevent the separating unit 38 from performing the separating operation until the sheet feeding tray 31 becomes empty.

By describing the operation of the automatic separating mode, the manual separating mode can be also understood. Hereinafter, a description will be provided for a case where the automatic separating mode is selected.

In the automatic separating mode, when a control signal for feeding the sheet to be subjected to the image formation from the sheet conveying device 140A is input from the system control section 92 to the sheet feeding and conveying control section 97, ACTs 1 to 9 illustrated in FIG. 6 are performed along the flowchart of FIG. 6.

Before ACT 1 is started, the movement tray 32B is positioned in the home position as illustrated in FIG. 8. The first contact-separation member 36A and the second contact-separation member 36B are positioned at the first retracted position and the second retracted position, respectively. The pressing member 37 is positioned at the first waiting position. As indicated by the solid line of FIG. 4, each end fence 31*e* is positioned at an advanced position.

In ACT 1, it is determined whether or not the sheet feeding tray 31 is empty. Specifically, on the basis of detection output of the empty sensor 40, the sheet feeding and conveying control section 97 determines whether or not the sheet feeding tray 31 is empty.

When the detection output of the empty sensor 40 indicates that there is no sheet on the tray bottom plate 31*c* (ACT 1: YES), ACT 2 is performed.

When the detection output of the empty sensor 40 indicates that there is a sheet on the tray bottom plate 31*c* (ACT 1: NO), ACT 8 is performed.

In ACT 2, it is determined whether or not the auxiliary tray 32 is empty. Specifically, on the basis of detection output of the empty sensor 42, the sheet feeding and conveying control section 97 determines whether or not the auxiliary tray 32 is empty.

When the detection output of the empty sensor 42 indicates that there is no sheet on the movement tray 32B (ACT 2: YES), ACT 9 is performed.

When the detection output of the empty sensor 42 indicates that there is a sheet on the movement tray 32B (ACT 2: NO), ACT 3 is performed.

In ACT 9, empty display of the sheet conveying device 140A is performed. Specifically, the sheet feeding and conveying control section 97 notifies the system control section 92 that the sheet conveying device 140A is empty. The system control section 92 controls the display 110*a* to perform display (empty display) indicating that the sheet conveying device 140A is empty. When the sheet feeding selection is performed by the external device, the system control section 92 notifies the external device that the sheet conveying device 140A is empty through the I/F 95 together with the display (the empty display) indicating that the sheet conveying device 140A is empty.

The system control section 92 stops the sheet feeding control for performing sheet feeding from the sheet conveying device 140A.

As above, ACT 9 is ended. When ACT 9 is ended, the sheet feeding control from the sheet conveying device 140A is ended.

When the empty display is made, a user of the image forming apparatus 100 sets the sheet bundle B in the sheet conveying device 140A according to necessity. The user draws out the cassette tray 140*a* and sets the sheet bundle B in the sheet conveying device 140A. When the sheet bundle B is the sheet bundle B1, the user sets the sheet bundle B in the auxiliary tray 32 in order to perform separating in the automatic separating mode. When the sheet bundle B is the sheet bundle B2 need not to be essentially separated, the user may set the sheet bundle B2 in the sheet feeding tray 31.

In a state in which the sheet conveying device 140A has been selected, when setting of the sheet bundle B is ended, the sheet feeding control illustrated in FIG. 6 is started from ACT 1.

The user may release the sheet feeding selection from the sheet conveying device 140A, and for example, may select sheet feeding from the cassette sheet feeding devices 140B and 140C. In such a case, since a control program for performing sheet feeding control of another sheet conveying device is executed, no separating is performed.

In ACT 3, separating is performed by the separating unit 38. Hereinafter, as illustrated in FIGS. 8 to 10, an example of a case where the sheet bundle B1 is placed in the movement tray 32B will be described.

In ACT 3, ACTs 11 to 15 illustrated in FIG. 7 are performed along the flowchart of FIG. 7.

In ACT 11, the second contact-separation member 36B abuts the sheet bundle B1. Specifically, the sheet feeding and conveying control section 97 sends a control signal to the arm driving section 53 and moves down the second contact-separation member 36B until the second contact-separation member 36B moves to the second abutting position. The contact-separation unit 36*a* of the second contact-separation member 36B abuts the upper surface S2 of the sheet bundle B1. The position of the sheet bundle B1 is regulated at the intermediate part in the movement direction (the y axis direction) of the movement tray 32B in the stacked direction (the z axis direction) of the sheet P1. Then, ACT 11 is ended.

After ACT 11, ACT 12 is performed. In ACT 12, the pressing member 37 moves from the first waiting position to the second waiting position while rotating forward. Specifically, the sheet feeding and conveying control section 97 sends a control signal to the pressing member driving section 54 to rotate the pressing member 37 forward (clockwise in the drawing). In such a state, the sheet feeding and conveying control section 97 sends a control signal to the pressing member driving section 54 to moves up the pressing member 37 until the pressing member 37 moves from the first waiting position (see the pressing member 37' in FIG. 9) to the second waiting position (see the pressing member 37" in FIG. 9).

Each roller 37*a* of the pressing member 37 abuts the lower surface S1 in the vicinity of the end surface E2 of the sheet bundle B1 during the moving-up. Each roller 37*a* rotates forward. Each roller 37*a* moves up while rubbing up the end surface E2 of the sheet bundle B1.

An end (a second end) in the vicinity of the end surface E2 of the sheet bundle B1 is bent in the z axis direction around the abutting part of the second contact-separation member 36B by frictional force acting on both ends in the x axis direction, which contact each roller 37*a*. Therefore, at the second end of the sheet bundle B1, the sheet bundle B1 causes shear deformation. At the second end, each sheet P1 causes relative slipping in a direction perpendicular to a stacked direction. When the relative slipping occurs, adhesion among the stacked sheets P1 is lower than before slipping.

As described above, in the present embodiment, the aforementioned "first type of separating" is performed by the pressing member 37.

Moreover, the second end of the sheet bundle B1 is turned up in the z axis direction by the frictional force acting on both ends in the x axis direction, which contact each roller 37*a*. That is, tangential force from each roller 37*a* moves up each sheet P1. Then, each sheet P1 moves down due to its own weight and collides with each roller 37*a* again. Moreover, when the end of each sheet P1 escapes down below each roller 37*a*, each sheet P1 falls down due to its own weight. Particularly, at a part of each sheet P1 in the vicinity of the lower surface S1, which is overhung from the inclined edge parts 32*g*, each sheet P1 falls down from the sheet placing plate 32*a* due to inertia.

By so doing, air enters between the sheets P1 in the vicinity of the end surface E2 and a gap is formed between the sheets P1. The sheets P1 are separated from one another and air enters, so that the second end of the sheet bundle B1 temporarily comes apart. Even though the separated sheets P1 temporarily overlap each other again, adhesion among the sheets is considerably reduced compared to the state before the separation.

As described above, in the present embodiment, the aforementioned "second type of separating" is performed by the pressing member 37.

When the pressing member 37 moves to the second waiting position, ACT 12 is ended.

In the present embodiment, since separating is performed due to the movement of each roller 37*a* of the pressing member 37, both ends in the x axis direction at the second end of the sheet bundle B can be separated with a greater force.

The sheet feeding roller 34A abuts the center of the sheet bundle B in the x axis direction and performs separation sheet feeding. Therefore, even though a plurality of sheets P1 reach the sheet feeding roller 34A, the center of each sheet P1 in the x axis direction is more likely to be separated due to the separation force of the sheet feeding roller 34A. However, the separation function of the sheet feeding roller 34A is not directly performed for both ends of each sheet P1 in the x axis direction. In the present embodiment, since both ends of each sheet P1 in the x axis direction, for which the separation function of the sheet feeding roller 34A is not easily performed, are separated with a greater force, it is possible to reliably prevent multi-feeding.

After ACT 12, ACT 13 is performed. In ACT 13, contact-separation member 36B is moved to the second retracted position and the first contact-separation member 36A abuts the sheet bundle B1. Specifically, the sheet feeding and conveying control section 97 sends a control signal to the arm driving section 53, and moves up the contact-separation member 36B to the second retracted position as illustrated in FIG. 10. Moreover, the sheet feeding and conveying control section 97 sends a control signal to the arm driving section 53, and moves up the first contact-separation member 36A until the first contact-separation member 36A moves to the first abutting position. The contact-separation unit 36*a* of the first contact-separation member 36A abuts the lower surface S1 of the sheet bundle B1. The position of the sheet bundle B1 is regulated at the intermediate part in the movement direction of the movement tray 32B in the stacked direction of the sheet P1. Then, ACT 13 is ended.

After ACT 13, ACT 14 is performed. In ACT 14, the pressing member 37 is moved from the second waiting position to the first waiting position while rotating backward. Specifically, the sheet feeding and conveying control section 97 sends a control signal to the pressing member driving section 54 to rotate the pressing member 37 backward (counterclockwise in the drawing). In such a state, the sheet feeding and conveying control section 97 sends a control signal to the pressing member driving section 54 to moves down the pressing member 37 until the pressing member 37 moves from the second waiting position (see the pressing member 37" in FIG. 10) to the first waiting position (see the pressing member 37"' in FIG. 10).

Each roller 37*a* of the pressing member 37 abuts the upper surface S2 in the vicinity of the end surface E2 of the sheet bundle B1 during the moving-down. Each roller 37*a* rotates backward. Each roller 37*a* moves down while rubbing down the end surface E2 of the sheet bundle B1.

In ACT 14, similarly to ACT 12, the aforementioned "first type of separating" and "second type of separating" are performed for the second end of the sheet bundle B1 by the pressing member 37. However, the movement direction of each roller 37*a* and the movement direction of the sheet P1 in ACT 14 are opposite to the movement direction of each roller 37*a* and the movement direction of the sheet P1 in ACT 12. In ACT 14, at the second end of the sheet bundle B, a part overhung from the inclined edge parts 32*g* is mainly bent at the x-axis negative direction side around the inclined edge parts 32*g*.

In ACT 14, since tangential force from each roller 37*a* coincides with the direction of gravity acting on the sheet bundle B1, more strong external force acts on the sheet bundle B1 as compared with ACT 12. When the pressing member 37 moves to the first waiting position, ACT 14 is ended.

After ACT 14, ACT 15 is performed. In ACT 15, the first contact-separation member 36A moves to the first abutting position. Specifically, the sheet feeding and conveying control section 97 sends a control signal to the arm driving section 53 to moves down the first contact-separation member 36A to the second retracted position. Then, ACT 15 is ended.

When ACT 15 is ended, the first contact-separation member 36A, the second contact-separation member 36B, and the pressing member 37 are disposed at the first retracted position, the second retracted position, and the first waiting position, respectively, as illustrated in FIG. 8.

After ACTs 11 to 15 are performed, ACT 3 in FIG. 6 is ended.

As illustrated in FIG. 6, after ACT 3, ACT 4 is performed. In ACT 4, as illustrated in FIG. 11, each end fence 31*e* of the sheet feeding tray 31 is retracted. Specifically, the sheet feeding and conveying control section 97 sends a control signal to the end fence driving section 51 (see FIG. 4) to retract each end fence 31*e* in the advanced state.

The opening 31*i* is widened to a width such that the sheet bundle B1 can pass through the opening 31*i* in the y axis direction. Then, ACT 4 is ended.

After ACT 4, ACT 5 is performed. In ACT 5, the movement tray 32B is moved to the advanced position. Specifically, the sheet feeding and conveying control section 97 sends a control signal to the slider driving section 52 (see FIG. 4) to move the slider 32*d* of the movement tray 32B in the y-axis positive direction. The movement tray 32B moves in the y-axis positive direction together with the slider 32*d*. In such a case, the sheet bundle B1 on the movement tray 32B is pressed in the y-axis positive direction by the extruding plate 32*c* abutting the end surface E1.

The sheet bundle B1 moves in the y-axis positive direction together with the movement tray 32B. The sheet bundle B1 enters into the opening 31*i* of the sheet feeding tray 31A by passing through the opening 32*i* between the side fences 32*f*. The second end of the sheet bundle B1 overhung from the inclined edge parts 32*g* is bent down due to its own weight. However, since the second end of the sheet bundle B1 rides up the upper surface of the inclined surface 31*d* of the tray bottom plate 31*c*, the second end is raised up along the inclined surface 31*d*. The second end of the sheet bundle B1 rides up on the tray bottom plate 31*c* without being caught in the tray bottom plate 31*c*.

On the other hand, the movement tray 32B moves without contacting anyone of the first contact-separation member 36A, the second contact-separation member 36B, and the pressing member 37. Moreover, the movement tray 32B moves onto the tray bottom plate 31*c* and the pressure plate 31*a* by passing through the openings 32*i* and 31*i*.

As indicated by the two dot chain line of FIG. 11, when the movement tray 32B arrives at the advanced position, the position sensor 41 (see FIG. 3) detects the arrival of the movement tray 32B. The position sensor 41 sends a detection signal to the sheet feeding and conveying control section 97. When the detection signal is received from the position sensor 41, the sheet feeding and conveying control section 97 sends a control signal to the slider driving section 52 to stop the slider 32*d*. Then, ACT 5 is ended.

After ACT 5, ACT 6 is performed. In ACT 6, the end fences 31*e* of the sheet feeding tray 31 are advanced. Specifically, the sheet feeding and conveying control section 97 sends a control signal to the end fence driving section 51 (see FIG. 4) to advance each end fence 31*e* in the retracted state as illustrated in FIG. 12.

The opening 31*i* is reduced to a certain width so that the sheet bundle B1 cannot pass through the opening 31*i* in the y axis direction. Each end fence 31*e* abuts the end surface E1 of the sheet bundle B from the y-axis negative direction side. Then, ACT 6 is ended.

After ACT 6, ACT 7 is performed. In ACT 7, the movement tray 32B is moved to the home position. Specifically, the sheet feeding and conveying control section 97 sends a control signal to the slider driving section 52 (see FIG. 4) to move the slider 32*d* of the movement tray 32B in the y-axis negative direction. As indicated by the two dot chain line of FIG. 12, the movement tray 32B moves in the y-axis negative direction together with the slider 32*d*. In such a case, the sheet bundle B1 on the movement tray 32B is supported from the y-axis negative direction by the end fences 31*e* abutting the end surface E1. The movement of the sheet bundle B1 is blocked by each end fence 31*e*. The sheet placing plate 32*a* moves in the y-axis negative direction while slipping with respect to the lower surface of the sheet bundle B1.

When the movement tray 32B is retracted from the sheet feeding tray 31, the sheet bundle B1 falls on the tray bottom plate 31*c* and the pressure plate 31*a* of the sheet feeding tray 31A. The sheet bundle B1 is stored in the sheet feeding tray 31A.

The empty sensor 40 detects that the sheet feeding tray 31A is not empty. The empty sensor 40 sends a detection signal to the sheet feeding and conveying control section 97.

When the movement tray 32B arrives at the home position, the position sensor 43 (see FIG. 3) detects the arrival of the movement tray 32B. The position sensor 43 sends a detection signal to the sheet feeding and conveying control section 97. When the detection signal is received from the position sensor 43, the sheet feeding and conveying control section 97 sends a control signal to the slider driving section 52 to stop the slider 32*d*. Then, ACT 7 is ended.

After ACT 7 or ACT 1: NO, ACT 8 is performed. In ACT 8, the completion of sheet feeding preparation is notified from the sheet feeding tray 31. Specifically, when receiving the detection signal indicating that the sheet feeding tray 31A is not empty from the empty sensor 40, the sheet feeding and conveying control section 97 sends a sheet feeding preparation completion signal to the system control section 92.

When receiving the sheet feeding preparation completion signal, the system control section 92 permits sheet feeding from the sheet conveying device 140A.

In this manner, the sheet feeding selection control related to the sheet conveying device 140A in the automatic separating mode is ended.

Next, an operation for forming an image on the sheet P of the sheet conveying device 140A in the image forming apparatus 100 will be briefly described.

When the sheet feeding from the sheet conveying device 140A is permitted, the sheet feeding from the sheet conveying device 140A and image formation to a sheet to be fed are started in accordance with a printing start signal. The printing start signal is sent to the system control section 92 by any one of an operation input from the operation unit 110, a signal input from the scanner unit 120, and a signal input from the external device.

When receiving the printing start signal, the system control section 92 inquires of the sheet feeding and conveying control section 97 about whether or not the sheet feeding from the sheet conveying device 140A is permitted.

When the sheet feeding is not permitted, the system control section 92 waits until the sheet feeding is permitted or sheet feeding selection is changed.

When the sheet feeding is permitted, the system control section 92 controls the control operations of the sheet feeding and conveying control section 97 and the image formation control section 98 to be started.

The image forming section 130A operates under the control of the image formation control section 98 in the control unit 91.

For example, the image forming section 130A operates as follows. The exposure unit 11 of the image forming section 130A forms electrostatic latent images on the photosensitive drums 12*b* to 16*b* on the basis of information on an image to be formed. The developing devices 12*a* to 16*a* of the image forming section 130A form visible images by attaching a developer to the electrostatic latent images. The primary transfer rollers 17 of the image forming section 130A transfer the formed visible images to the intermediate transfer belt 18.

In parallel with the above, the sheet feeding and conveying control section 97 performs the following control.

The sheet feeding and conveying control section 97 drives the pick-up roller 35A and the sheet feeding roller 34A, thereby conveying the sheet P1 positioned on the upper surface S2 of the sheet bundle B1 to a conveyance path (not illustrated). In such a case, since the sheet bundle B1 has been separated in advance, adhesion among sheets is reduced. As compared with a case where the sheet bundle B1 has not been separated, the sheet feeding roller 34A can easily separate the uppermost sheet P1 from a sheet P1 under the uppermost sheet P1. As a consequence, multi-feeding of the sheet P1 can be prevented.

The leading end position of the sheet P1 conveyed to the conveyance path is adjusted by the registration roller in the image forming section 130A.

The system control section 92 starts to drive the registration roller such that the leading end of the sheet P1 reaches a second transfer position when the leading end of the visible image reaches the second transfer position.

The secondary transfer roller 20 of the image forming section 130A transfers the visible image formed on the intermediate transfer belt 18 onto the sheet P1 having reached the second transfer position. The sheet feeding and conveying control section 97 causes the sheet P1 with the transferred visible image to be conveyed to the fixing section 130B. On the basis of the control of the fixing control section 99, the fixing section 130B heats and presses the sheet P1. The fixing section 130B conveys the sheet P1 to the sheet discharge section 130C. On the basis of the control of the sheet feeding and conveying control section 97, the sheet discharge section 130C discharges the sheet P1 to a sheet discharge tray. By so doing, image formation to the sheet P1 is completed.

As described above, in the image forming apparatus 100 according to the present embodiment, in a case where the automatic separating mode is selected, when sheet feeding from the sheet conveying device 140A is selected, if the sheet feeding tray 31 is empty, the sheet bundle B stored in the auxiliary tray 32 is automatically separated. The sheet bundle B is separated and then is moved to the sheet feeding tray 31. Since the sheet bundle B is separated, the sheet bundle B is conveyed to the conveyance path in the printer unit 130 without multi-feeding.

As described above, in the automatic separating mode, the sheet bundle B stored in the auxiliary tray 32 is essentially separated before being fed. Therefore, the sheet bundle B1 needed to be separated is set in the auxiliary tray 32, so that manual separating time and effort of the sheet bundle B1 are saved.

Next, an operation of the image forming apparatus 100 when the manual separating mode is selected will be briefly described.

When a separating command is input from the operation unit 110, an operation based on the flow, except for ACT 1 and ACT 4 to ACT 8 in FIG. 6, is performed.

In a case where the manual separating mode is selected, when sheet feeding from the sheet conveying device 140A is selected, an operation based on the flow, except for ACT 3 in FIG. 6, is performed.

In the manual separating mode, for example, after a user sets the sheet bundle B1 in the auxiliary tray 32 and then inputs a separating command for performing separating. As a result, it is possible to prevent multi-feeding.

Moreover, while the sheet bundle B1 is in the auxiliary tray 32, a user can allow the separating to be performed any number of times according to necessity. Consequently, even though the sheet bundle B1 is stored in the auxiliary tray 32 for a long time, separating is performed at an appropriate interval, so that it is possible to hold a state in which adhesion among sheets is low.

A user may set the sheet bundle B1, which has been separated by the sheet conveying device 140A, in another sheet feeding device again.

In the above description, any one of the manual separating mode and the automatic separating mode are selected. However, for example, the manual separating mode may be set as a mode interruptible to the automatic separating mode.

In such a case, even though the automatic separating mode is selected, the automatic separating mode can be switched to the manual separating mode in an interruptible period in which separating and movement of the sheet bundle B in the automatic separating mode are not performed. In such a case, in the interruptible period, frequent separating can be performed. For example, in the automatic separating mode, when the sheet feeding tray 31 is not empty, separating is not performed, but a user inputs a separating command, so that separating can be performed. When an operation of the manual separating mode is ended, the manual separating mode is returned to the automatic separating mode.

As described above, according to the image forming apparatus 100 and the sheet conveying device 140A of the present embodiment, a sheet bundle before being fed can be separated by the separating unit 38. As a result, it is possible to suppress the occurrence of multi-feeding at the time of sheet feeding from the sheet conveying device 140A.

Second Embodiment

A sheet conveying device and an image forming apparatus according to a second embodiment will be described with reference to the drawing.

Figure 13:
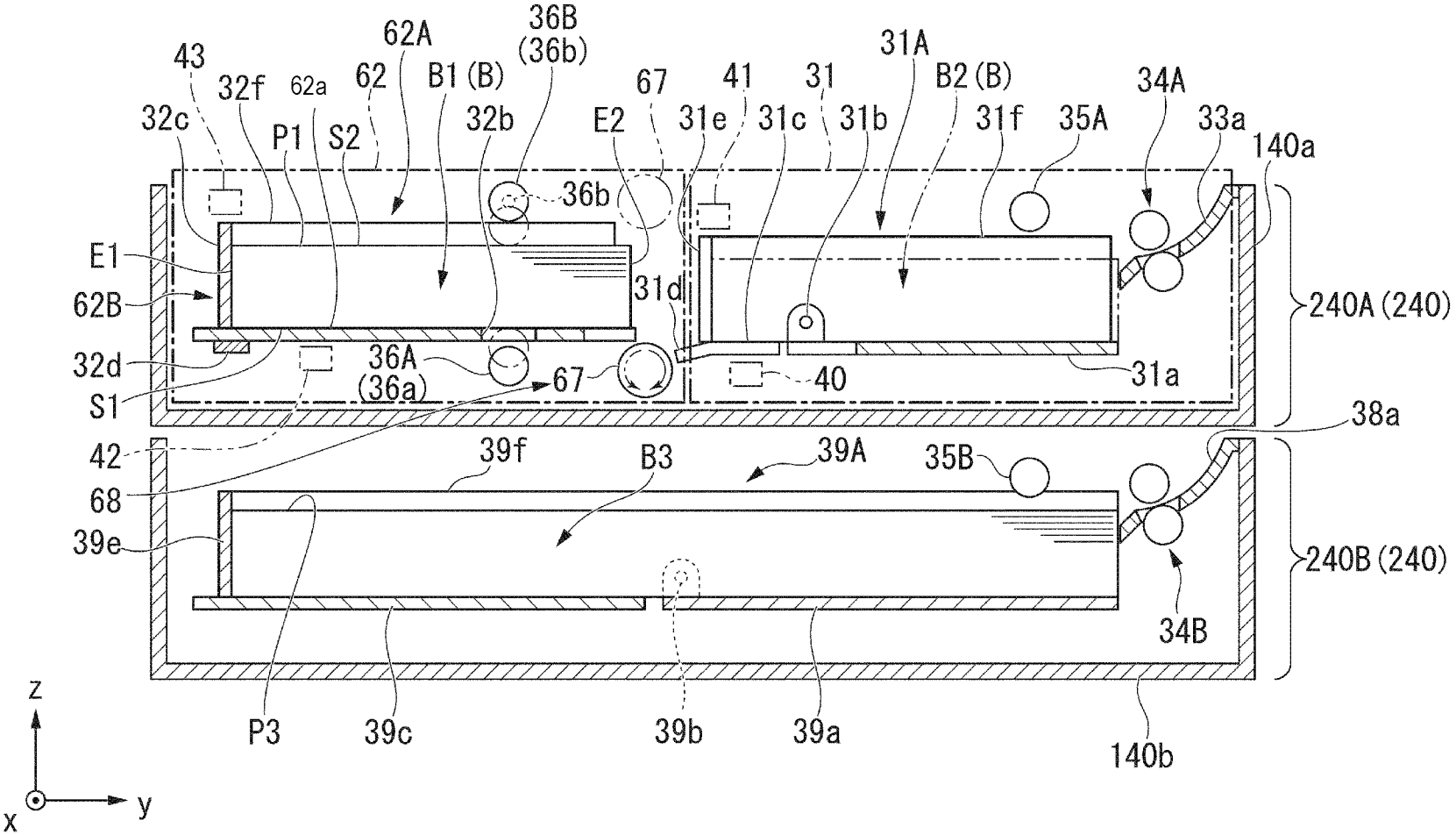
FIG. 13 illustrates a cross-sectional view of main elements of a sheet conveying device according to a second embodiment.
Figure 14:
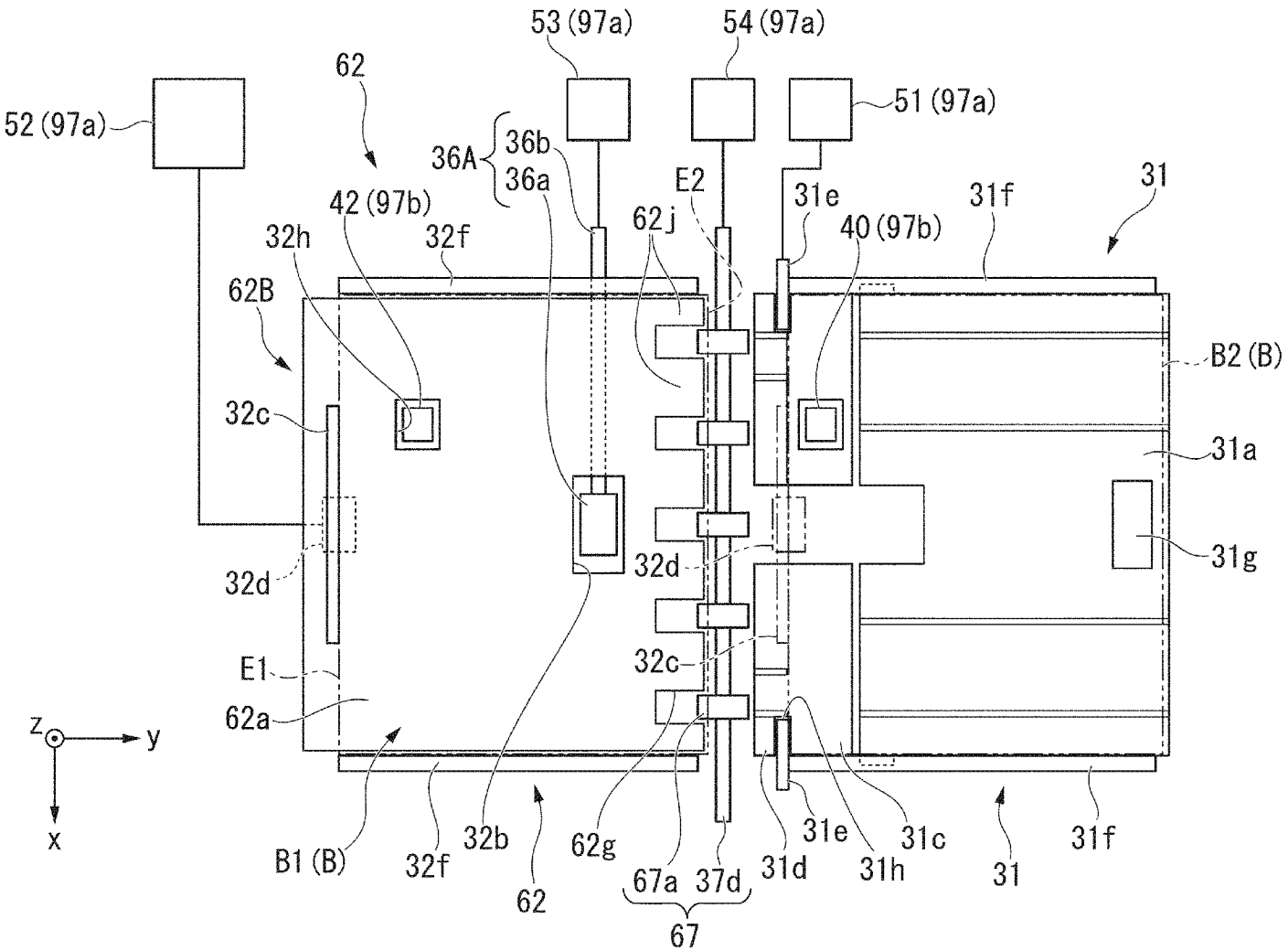
FIG. 14 illustrates a plan view of main elements of the sheet conveying device according to the second embodiment.

FIG. 13 illustrates a cross-sectional view of main elements of the sheet conveying device according to the second embodiment. FIG. 14 illustrates a plan view of the main elements of the sheet conveying device according to the second embodiment.

As illustrated in FIG. 13, an image forming apparatus 200 according to the second embodiment includes a sheet feeding device 240 instead of the sheet feeding device 140 of image forming apparatus 100 according to the first embodiment.

The sheet feeding device 240 includes a sheet conveying device 240A instead of the sheet conveying device 140A of the sheet feeding device 140 according to the first embodiment.

Hereinafter, differences with the first embodiment will be mainly described.

As illustrated in FIG. 13, the sheet conveying device 240A includes an auxiliary tray 62, a storage tray 62A, and a movement tray 62B instead of the auxiliary tray 32, the storage tray 32A, and the movement tray 32B of the first embodiment. The auxiliary tray 62, the storage tray 62A, and the movement tray 62B respectively include a sheet placing plate 62*a* instead of the sheet placing plate 32*a* of the auxiliary tray 32, the storage tray 32A, and the movement tray 32B.

Moreover, the sheet conveying device 240A includes a separating unit 68 instead of the separating unit 38 of the first embodiment. The separating unit 68 includes a pressing member 67 (a rotating roller) instead of the pressing member 37 of the separating unit 38.

As illustrated in FIG. 14, the sheet placing plate 62*a* is different from the sheet placing plate 32*a* of the first embodiment in terms of the shape of an end at the y-axis positive direction side.

At an end at the y-axis positive direction side of the sheet placing plate 62*a*, a plurality of notched parts 62*g* having a rectangular shape in the plan view are formed and extend in the y axis direction. The length in the y axis direction of the notched part 62*g* is shorter than a distance between an end edge at the y-axis positive direction side of the sheet placing plate 62*a* and the through hole 32*b*. The number of the notched parts 62*g* and an arrangement interval thereof in the x axis direction are not particularly limited. In the example illustrated in FIG. 14, the notched parts 62*g* are formed at five places at regular intervals in the x axis direction.

At the end at the y-axis positive direction side of the sheet placing plate 62*a*, a plurality of projection pieces 62*j* having a comb tooth shape as a whole are formed in an area except for the notched parts 62*g*.

The pressing member 67 includes a plurality of rollers 67*a* instead of the plurality of rollers 37*a* of the pressing member 37 in the first embodiment.

In the example illustrated in FIG. 14, the rollers 67*a* are fixed to the rotating shafts 37*b* at five places separated from one another in the longitudinal direction of the rotating shaft 37*b*. In the plan view, each roller 67*a* is disposed at a position facing, in the x axis direction, each notched part 62*g* of the auxiliary tray 62 in the home position.

An external appearance of each roller 67*a* is a columnar shape coaxial with the rotating shaft 37*b*. An outer diameter of each roller 67*a* is larger than a distance between the center shaft line of the rotating shaft 37*b* and the end surface E2 of the sheet bundle B placed in the movement tray 62B positioned in the home position.

As a material of each roller 67*a*, a material identical to that of the roller 37*a* of the first embodiment may be used. A surface of each roller 67*a* may be formed with a concave-convex surface similar to the surface of the roller 37*a* of the first embodiment.

As described above, in the sheet conveying device 240A, the shapes of the sheet placing plate 62*a* and the pressing member 67 are different from those of the sheet placing plate 32*a* and the pressing member 37. In the image forming apparatus 200, similarly to the image forming apparatus 100 of the first embodiment, the sheet bundle B placed on the auxiliary tray 62 is separated under the control of the control unit 91.

Hereinafter, a separating operation in the present embodiment will be described while focusing on the difference with the first embodiment.

For example, in the automatic separating mode of the present embodiment, operations similar to FIGS. 6 and 7 are performed.

For example, in ACT 12 of the present embodiment, the pressing member 67 moves from the first waiting position to the second waiting position while rotating forward.

However, the pressing member 67 includes the plurality of rollers 67*a* between both ends in the x axis direction as well as at both ends in the x axis direction. The second end of the sheet bundle B is approximately equally rubbed up in the x axis direction due to the movement of the pressing member 67. Consequently, a center in the x axis direction is also separated similarly to both ends in the x axis direction. As a consequence, it is possible to further improve the separation performance of the sheet feeding roller 34A.

For example, in ACT 14 of the present embodiment, the pressing member 67 moves from the first waiting position to the second waiting position while rotating backward.

The second end of the sheet bundle B is approximately equally rubbed down in the x axis direction due to the movement of the pressing member 67.

In the present embodiment, the lower surface S1 of the sheet bundle B at the second end is horizontally supported from below by the projection pieces 62*j* having a comb tooth shape. The sheet bundle B is not actually overhung from an edge at the y-axis positive direction side of the projection piece 62*j*. However, in an area where the projection piece 62*j* is formed, stiffness of the sheet placing plate 62*a* is reduced as compared with the end at the y-axis negative direction side of the sheet placing plate 62*a*. Therefore, each projection piece 62*j* is also bent in the z-axis negative direction side together with the sheet bundle B due to external force acting on the end surface E2 from the roller 67*a* in the z-axis negative direction. As a consequence, also in ACT 14 of the present embodiment, similarly to ACT 12, the "first type of separating" and the "second type of separating" are performed.

As described above, according to the image forming apparatus 200 and the sheet conveying device 240A of the present embodiment, a sheet bundle before being fed can be separated by the separating unit 68, so that it is possible to suppress the occurrence of multi-feeding at the time of sheet feeding from the sheet conveying device 240A.

According to at least one described embodiment, it is possible to provide the sheet conveying device and the image forming apparatus that can suppress the occurrence of multi-feeding at the time of sheet feeding.

Hereinafter, a modification example of the aforementioned each embodiment will be described.

In the aforementioned embodiments, the pressing member in the separating unit reciprocates once between the first waiting position and the second waiting position, so that a one-time separating operation is performed. However, the number of times of movement of the pressing member is not limited to one reciprocation.

For example, the pressing member may be moved two reciprocations or more.

For example, the pressing member reciprocates by 1/2 , so that a one-time separating operation may be performed. In such a case, the pressing member moves from the first waiting position to the second waiting position or moves from the second waiting position from the first waiting position, so that a one-time separating operation is performed.

For example, the pressing member may perform a one-time separating operation in a forward way from the first waiting position to the second waiting position, and may move in a return way from the second waiting position to the first waiting position without performing a separating operation.

The aforementioned each embodiment has described an example in which ACTs 3 and 4 are performed in this order. However, the execution order of ACTs 3 and 4 may be changed. Moreover, ACT 4 may be performed while ACT 3 is performed.

In the aforementioned embodiments, the pressing member includes a rotating roller and is rotated forward when separating is performed. However, the rotation direction of the pressing member may be switched during movement to one direction or may be temporarily stopped. In such a case, since there is a change in the direction of external force acting on a sheet to be contacted, the sheet is more likely to come apart.

Moreover, the pressing member may be configured with a non-rotating member if it is possible to apply a frictional force enough for separating to the end surface of the sheet bundle B.

In the aforementioned embodiments, the pressing member rubs the end surface E2 of the sheet bundle B in order to perform the "second type of separating". However, when it is possible to reduce adhesion among sheets required for multi-feeding suppression only by the "first type of separating" for bending the second end of the sheet bundle B, the pressing member may not need to rub the end surface E2.

For example, the pressing member applies external force to at least one of the lower surface S1 and the upper surface S2 of the sheet bundle B, so that the second end of the sheet bundle B is bent.

In the aforementioned embodiments, the sheet bundle B is placed on the movement tray including the extruding plate 32*c* and is moved from the auxiliary tray to the sheet feeding tray. However, when a conveyance path enabling sliding movement of the sheet bundle B is formed between the auxiliary tray to the sheet feeding tray, the sheet bundle B may be moved only by the extruding plate 32*c*.

In the aforementioned embodiments, the image forming section 130A is a quintuple tandem type. However, the image forming section is not limited to the quintuple tandem type. For example, the image forming section maybe a four-drum tandem type. For example, the image forming section may have a configuration in which a plurality of developing device are disposed along the photosensitive drum.

In the aforementioned embodiments, the image forming apparatus is a multifunctional peripheral. However, the image forming apparatus is not limited to the multifunctional peripheral. For example, the image forming apparatus may be a printer, a facsimile, a copy machine, and the like.

Moreover, an image forming unit of the image forming apparatus is not limited to an electrophotographic scheme. For example, the image forming apparatus may be an inkjet apparatus.

In the aforementioned embodiments, the sheet conveying device is provided as a part of the image forming apparatus. However, the sheet conveying device may be provided as a part of a document conveying device.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein maybe made without departing from the spirit of the inventions. The accompanying claims and their equivalents are intended to cover such forms or modifications as would fall within the scope and spirit of the invention.

What is claimed is:

1. A sheet conveying device comprising:

an auxiliary tray;

a sheet feeding tray adjacent to the auxiliary tray on a lateral side of the auxiliary tray;

a roller configured to move in a thickness direction of a sheet bundle placed on the auxiliary tray to contact an end of the sheet bundle facing the sheet feeding tray;

a driving mechanism configured to laterally move the auxiliary tray to be on top of the sheet feeding tray when the sheet bundle placed on the auxiliary tray is transferred to the sheet feeding tray; and a pickup roller configured to pick up a sheet one by one from the sheet bundle transferred to the sheet feeding tray.

2. The sheet conveying device according to claim 1, further comprising:

a controller configured to cause the roller to move in a first thickness direction of the sheet bundle on the auxiliary tray and in a second thickness direction opposite to the first thickness direction.

3. The sheet conveying device according to claim 2, wherein the controller is further configured to cause the roller to reciprocate in the first and second thickness directions a plurality of times.

4. The sheet conveying device according to claim 2, wherein the controller is further configured to control the roller to rotate in a first rotational direction when the roller moves in the first thickness direction, and in a second rotational direction opposite to the first rotational direction when the roller moves in the second thickness direction.

5. The sheet conveying device according to claim 2, further comprising:

a first contact member; and a second contact member, wherein the controller is further configured to:

cause the first contact member to move to a position at which the first contact member is in contact with an end surface of the sheet bundle on the auxiliary tray in the first thickness direction when the roller moves in the first thickness direction; and cause the second contact member to move to a position at which the second contact member is in contact with an end surface of the sheet bundle on the auxiliary tray in the second thickness direction when the roller moves in the second thickness direction.

6. The sheet conveying device according to claim 5, wherein the first contact member is not in contact with the sheet bundle on the auxiliary tray when the roller moves in the second thickness direction, and the second contact member is not in contact with the sheet bundle on the auxiliary tray when the roller moves in the first thickness direction.

7. The sheet conveying device according to claim 5, wherein the first contact member contacts the end surface of the sheet bundle on the auxiliary tray in the first thickness direction through an opening formed in the auxiliary tray.

8. The sheet conveying device according to claim 1, further comprising:

an end fence positioned at an end of the sheet feeding tray facing the auxiliary tray and movable in a direction along the end of the sheet feeding tray between a closed position preventing entry of the sheet bundle on the auxiliary tray and an open position allowing entry of the sheet bundle on the auxiliary tray.

9. The sheet conveying device according to claim 8, further comprising:

a controller configured to cause the end fence to move to the open position when the auxiliary tray moves to the sheet feeding tray, and move to the closed position when the auxiliary tray moves apart from the sheet feeding tray.

10. The sheet conveying device according to claim 9, wherein when the auxiliary tray moves apart from the sheet feeding tray, the end fence at the closed position restricts movement of the sheet bundle on the auxiliary tray along with the auxiliary tray and causes the sheet bundle to fall onto the sheet feeding tray.

11. The sheet conveying device according to claim 1, further comprising:

a first sheet sensor at the auxiliary tray;

a second sheet sensor at the sheet feeding tray; and a controller configured to:

determine whether or not a sheet bundle is on the auxiliary tray based on a detection result of the first sheet sensor and whether or not the sheet feeding tray is empty based on a detection result of the second sheet sensor, and carrying out a sheet separation operation by controlling the roller to move in the thickness direction of the sheet bundle on the auxiliary tray, upon determining that the sheet bundle is on the auxiliary tray and the sheet feeding tray is empty.

12. The sheet conveying device according to claim 11, wherein the controller is configured to control the driving mechanism to laterally move the auxiliary tray on top of the sheet feeding tray after carrying out the sheet separation.

13. The sheet conveying device according to claim 1, wherein an end of the auxiliary tray facing the sheet feeding tray includes a recessed portion through which the roller moves in the thickness direction of the sheet bundle on the auxiliary tray.

14. The sheet conveying device according to claim 1, wherein the roller includes a plurality of roller portions at different positions of a rotational axis, and each of the roller portions contact the end of the sheet bundle facing the sheet feeding tray.

15. An image forming apparatus comprising:

an image forming device configured to form an image on a sheet; and a sheet conveying device configured to convey a sheet to the image forming device, the sheet conveying device including:

an auxiliary tray;

a sheet feeding tray adjacent to the auxiliary tray on a lateral side of the auxiliary tray;

a roller configured to move in a thickness direction of a sheet bundle placed on the auxiliary tray to contact an end of the sheet bundle facing the sheet feeding tray;

a driving mechanism configured to laterally move the auxiliary tray to be on top of the sheet feeding tray when the sheet bundle placed on the auxiliary tray is transferred to the sheet feeding tray; and a pickup roller configured to pick up a sheet one by one from the sheet bundle transferred to the sheet feeding tray.

16. The image forming apparatus according to claim 15, further comprising:

a controller configured to cause the roller to move in a first thickness direction of the sheet bundle on the auxiliary tray and in a second thickness direction opposite to the first thickness direction.

17. The image forming apparatus according to claim 16, wherein the controller is further configured to cause the roller to reciprocate in the first and second thickness directions a plurality of times.

18. The image forming apparatus according to claim 16, wherein the controller is further configured to control the roller to rotate in a first rotational direction when the roller moves in the first thickness direction, and in a second rotational direction opposite to the first rotational direction when the roller moves in the second thickness direction.

19. The image forming apparatus according to claim 16, wherein the sheet conveying device further includes:

a first contact member; and a second contact member, wherein the controller is further configured to:

cause the first contact member to move to a position at which the first contact member is in contact with an end surface of the sheet bundle on the auxiliary tray in the first thickness direction when the roller moves in the first thickness direction; and cause the second contact member to move to a position at which the second contact member is in contact with an end surface of the sheet bundle on the auxiliary tray in the second thickness direction when the roller moves in the second thickness direction.

20. The image forming apparatus according to claim 15, wherein the sheet conveying device further includes:

an end fence positioned at an end of the sheet feeding tray facing the auxiliary tray and movable in a direction along the end of the sheet feeding tray between a closed position preventing entry of the sheet bundle on the auxiliary tray and an open position allowing entry of the sheet bundle on the auxiliary tray.

* * * * *